US011298951B2

(12) United States Patent
Kishii et al.

(10) Patent No.: US 11,298,951 B2
(45) Date of Patent: Apr. 12, 2022

(54) LIQUID EJECTING APPARATUS AND METHOD OF FILLING LIQUID IN LIQUID EJECTING APPARATUS

(71) Applicant: Seiko Epson Corporation, Tokyo (JP)

(72) Inventors: Yoshiaki Kishii, Nagano (JP); Hisashi Sato, Nagano (JP); Eri Tanaka, Nagano (JP); Kazuyuki Fujioka, Nagano (JP); Yuichi Urabe, Nagano (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/996,155

(22) Filed: Aug. 18, 2020

(65) Prior Publication Data

US 2021/0053359 A1 Feb. 25, 2021

(30) Foreign Application Priority Data

Aug. 19, 2019 (JP) ..... JP2019-149681

(51) Int. Cl.
*B41J 2/175* (2006.01)

(52) U.S. Cl.
CPC ..... *B41J 2/17566* (2013.01); *B41J 2/17596* (2013.01)

(58) Field of Classification Search
CPC .... B41J 2/16526; B41J 2/16532; B41J 2/175; B41J 2/17506; B41J 2/17509; B41J 2/17513; B41J 2/1752; B41J 2/17523; B41J 2/17566; B41J 2/17596; B41J 29/02; B41J 29/13; B41J 2002/17516
See application file for complete search history.

(56) References Cited

U.S. PATENT DOCUMENTS

| | | | | |
|---|---|---|---|---|
| 6,315,402 | B1 | 11/2001 | Kawase | |
| 2002/0113852 | A1 | 8/2002 | Kimura et al. | |
| 2004/0141023 | A1 | 7/2004 | Nakamura | |
| 2009/0179974 | A1* | 7/2009 | Kimura | B41J 2/17509 347/85 |
| 2017/0087867 | A1* | 3/2017 | Sato | B41J 2/17556 |

(Continued)

FOREIGN PATENT DOCUMENTS

| | | | |
|---|---|---|---|
| JP | H09328192 | A | 12/1997 |
| JP | 2000141687 | A | 5/2000 |

(Continued)

*Primary Examiner* — Anh T Vo
(74) *Attorney, Agent, or Firm* — Chip Law Group

(57) ABSTRACT

A liquid ejecting apparatus including a liquid ejecting portion that ejects a liquid, a liquid supply flow path that supplies the liquid accommodated in a liquid supply source to the liquid ejecting portion, a storage portion that is provided in the liquid supply flow path and that stores the liquid, a pressure mechanism that changes a volume of the storage portion by making pressure act thereon, a liquid filling mechanism that fills the liquid inside the liquid supply source into the liquid supply flow path, and a control portion that fills the liquid into the liquid supply flow path while the volume of the storage portion is, by making pressure act on the flexible portion, made smaller than when the pressure does not act on the flexible portion, and after the filling, ends a state in which the pressure is made to act on the flexible portion.

4 Claims, 8 Drawing Sheets

(56) References Cited

U.S. PATENT DOCUMENTS

| | | | | |
|---|---|---|---|---|
| 2018/0326739 | A1* | 11/2018 | Maruyama | B41J 29/13 |
| 2018/0361751 | A1 | 12/2018 | Shinoda et al. | |
| 2019/0077165 | A1* | 3/2019 | Nakajima | B41J 2/19 |

FOREIGN PATENT DOCUMENTS

| | | | |
|---|---|---|---|
| JP | 2003159809 | A | 6/2003 |
| JP | 2003170607 | A | 6/2003 |
| JP | 2003211689 | A | 7/2003 |
| JP | 2004188410 | A | 7/2004 |
| JP | 2005074627 | A | 3/2005 |
| JP | 2006224566 | A | 8/2006 |
| JP | 2007098857 | A | 4/2007 |
| JP | 2007105923 | A | 4/2007 |
| JP | 2007326256 | A | 12/2007 |
| JP | 2012196342 | A | 10/2012 |
| JP | 2017144682 | A | 8/2017 |
| JP | 2019001053 | A | 1/2019 |

* cited by examiner

LIQUID EJECTING APPARATUS AND METHOD OF FILLING LIQUID IN LIQUID EJECTING APPARATUS

The present application is based on, and claims priority from JP Application Serial Number 2019-149681, filed Aug. 19, 2019, the disclosure of which is hereby incorporated by reference herein in its entirety.

BACKGROUND

1. Technical Field

The present disclosure relates to a liquid ejecting apparatus such as an ink jet printer, and a method of filling a liquid in the liquid ejecting apparatus.

2. Related Art

JP-A-2003-211689 describes an example of an ink jet recording apparatus provided with a sub tank in an ink supply flow path that connects a main tank and a recording head to each other. In the recording apparatus, the sub tank is bag shaped. Furthermore, an electrically controlled opening/closing member is disposed in the ink supply flow path between the sub tank and the main tank.

According to JP-A-2003-211689, when ink inside the main tank is initially filled into the sub tank, a first process is executed, and a second process is executed after the first process. In the first process, the opening/closing member is opened without any application of pressure to the main tank, a negative pressure is made to act on the recording head, and, furthermore, the sub tank is squashed by atmospheric pressure. In the second process, pressure is applied to the main tank while maintaining a state in which the opening/closing member is open and a state in which the negative pressure is made to act on the recording head. In the second process, the ink inside the main tank is filled into the ink supply flow path and the sub tank with the application of pressure to the main tank.

When an upstream flow path is a portion in the ink supply flow path between the main tank and the sub tank, there are cases in which air is present in the upstream flow path at the end of the first process. In such a state, when the process moves on to the second process from the first process, the air present in the upstream flow path may flow into the sub tank together with the ink that has been made to flow out from the main tank.

Such an issue is not limited to an ink jet recording apparatus and may occur in liquid ejecting apparatuses in general that include a liquid ejecting portion that ejects a liquid through a nozzle.

SUMMARY

A liquid ejecting apparatus that overcomes the above issue includes a liquid ejecting portion that ejects a liquid through a nozzle, a liquid supply flow path configured to supply the liquid accommodated in a liquid supply source to the liquid ejecting portion, a storage portion that is provided in the liquid supply flow path and that stores the liquid, in which the storage portion includes a flexible portion and in which a volume of the storage portion changes when the flexible portion is deformed, a pressure mechanism that changes the volume of the storage portion by making pressure act on the flexible portion, a liquid filling mechanism that fills the liquid inside the liquid supply source into the liquid supply flow path, and a control portion that controls the pressure mechanism and the liquid filling mechanism. The control portion executes a filling process that fills the liquid into the liquid supply flow path with the liquid filling mechanism while the volume of the storage portion is, by making pressure act on the flexible portion with the pressure mechanism, made smaller than when the pressure does not act on the flexible portion, and after executing the filling process, an ending process that ends the state in which the pressure is made to act on the flexible portion with the pressure mechanism.

A method of filling a liquid in a liquid ejecting apparatus that overcomes the above issue is a method of filling a liquid in a liquid ejecting apparatus including a liquid ejecting portion that ejects the liquid through the nozzle, a liquid supply flow path configured to supply the liquid accommodated in a liquid supply source to the liquid ejecting portion, and a storage portion that is provided in the liquid supply flow path and that stores the liquid, in which the storage portion includes a flexible portion and changes a volume thereof when the flexible portion is deformed. In the filling method, the liquid is filled into the liquid supply flow path while the volume of the storage portion is, by making pressure act on the flexible portion, made smaller than when the pressure does not act on the flexible portion, and after the filling, a state in which the pressure is made to act on the flexible portion is ended.

DESCRIPTION OF EXEMPLARY EMBODIMENTS

Hereinafter, an exemplary embodiment of a liquid ejecting apparatus and a method of filling a liquid in the liquid ejecting apparatus will be described with reference to the drawings. The liquid ejecting apparatus includes, for example, an ink jet printer that prints images such as a character and a photographic image by ejecting ink, which is an example of a liquid, on a medium such as a sheet of paper.

Figure 1:
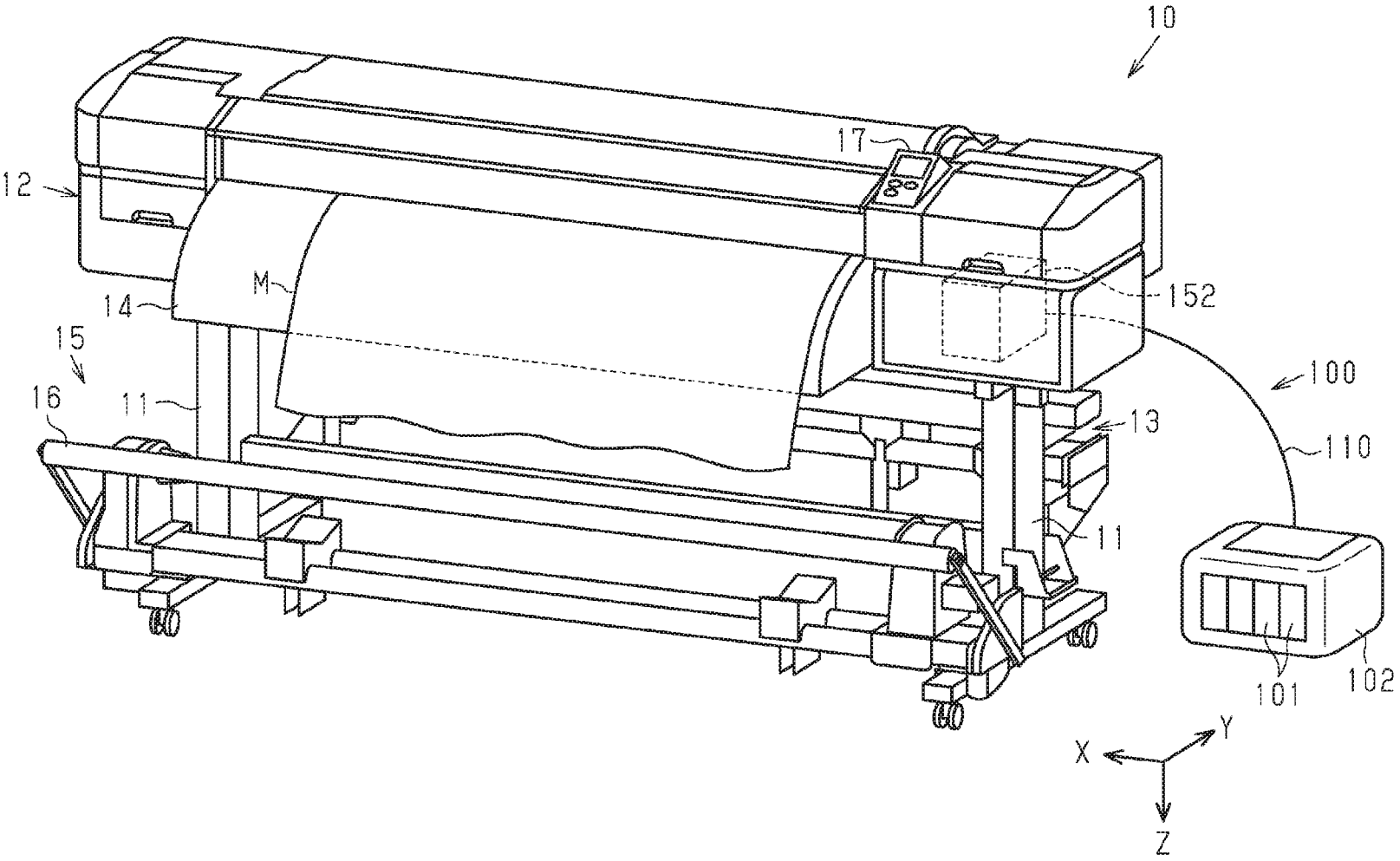
FIG. 1 is a perspective view illustrating an exemplary embodiment of a liquid ejecting apparatus.

As illustrated in FIG. 1, a liquid ejecting apparatus 10 includes a pair of leg portions 11, and a housing 12 installed on the leg portions 11. The liquid ejecting apparatus 10 includes a feed portion 13 that feeds a medium M, which is wound around a roll member, towards the inside of the housing 12, a guide portion 14 that guides the medium M discharged from the housing 12, and a winding portion 15 that winds the medium M, which is guided by the guide portion 14, around a roll member. The liquid ejecting apparatus 10 includes a tension applying mechanism 16 that applies tension to the medium M that is wound by the winding portion 15, and an operation panel 17 operated by the user.

The liquid ejecting apparatus 10 installed at a place of use has a predetermined width, a predetermined depth, and a predetermined height. Assuming that the liquid ejecting apparatus 10 is installed on a horizontal surface, the gravitational direction is indicated by a Z-axis. In the above state, a width direction and a depth direction of the liquid ejecting apparatus 10 are substantially horizontal. The depth direction of the liquid ejecting apparatus 10 is indicated by a Y-axis. The width direction of the liquid ejecting apparatus 10 is indicated by an X-axis that intersects the Y-axis and the Z-axis. Accordingly, the X-axis, the Y-axis, and the Z-axis are coordinate axes that indicate the lengths in the width direction, the depth direction, and the height direction, respectively.

Figure 2:
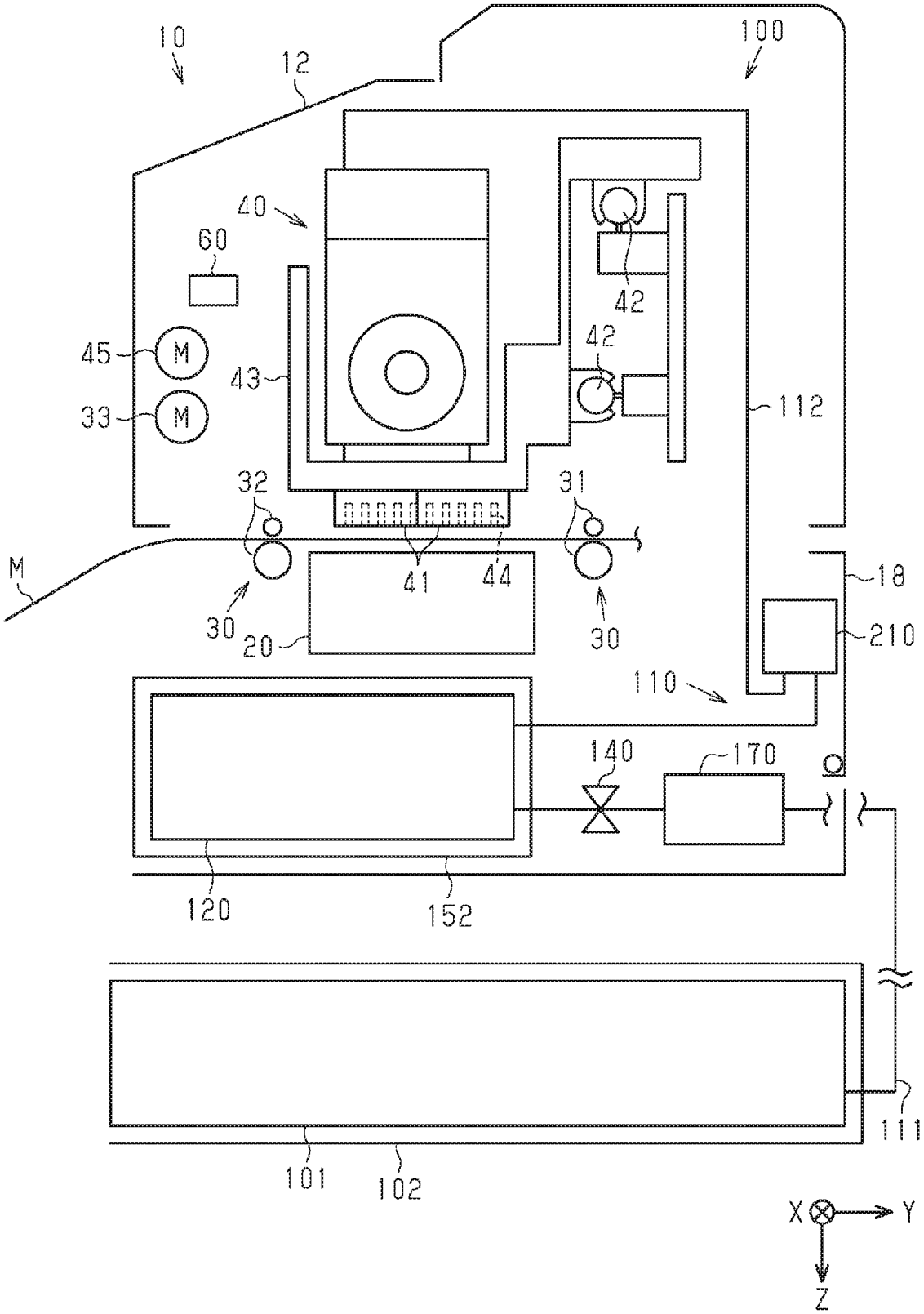
FIG. 2 is a side view schematically illustrating an inner configuration of the liquid ejecting apparatus.

As illustrated in FIG. 2, the liquid ejecting apparatus 10 includes a support base 20 that supports the medium M, and a transport portion 30 that transports the medium M. The liquid ejecting apparatus 10 includes a printing portion 40 that performs printing on the medium M, and a control portion 60 that controls the operation of the liquid ejecting apparatus 10. The liquid ejecting apparatus 10 includes a liquid supplying apparatus 100 that supplies the liquid to the printing portion 40. The control portion 60 is configured to include a CPU and a memory, for example. The control portion 60 controls the liquid ejecting apparatus 10 and the liquid supplying apparatus 100 by having the CPU execute a program stored in the memory.

The support base 20 is provided so as to extend in the width direction. In the present exemplary embodiment, the width direction of the liquid ejecting apparatus 10 coincides with the width direction of the medium M. The medium M on the support base 20 is transported in a direction opposite the depth direction. Accordingly, a transport direction of the medium M is a direction opposite the depth direction.

The transport portion 30 includes a first transport roller pair 31 positioned beyond the support base 20 in the depth direction, and a second transport roller pair 32 positioned before the support base 20 in the depth direction. The transport portion 30 includes a transport motor 33 that drives the first transport roller pair 31 and the second transport roller pair 32. By driving the first transport roller pair 31 and the second transport roller pair 32 with the transport motor 33, the medium M nipped between the first transport roller pair 31 and the second transport roller pair 32 is transported in the transport direction and along a surface of the support base 20.

The printing portion 40 includes a liquid ejecting portion 41 that ejects the liquid through a nozzle 44. In the present exemplary embodiment, the printing portion 40 includes a guide shaft 42 provided so as to extend in the width direction, and a carriage 43 configured to reciprocate in the width direction by being guided by the guide shaft 42.

The printing portion 40 includes a carriage motor 45 that moves the carriage 43 along the guide shaft 42. The carriage 43 is moved with the drive of the carriage motor 45. In other words, the liquid ejecting apparatus 10 of the present exemplary embodiment is of a serial type in which the liquid ejecting portion 41 scans the medium M. The liquid ejecting apparatus 10 may be of a line type in which the liquid ejecting portion 41 is provided so as to be elongated in the width direction.

Figure 3:
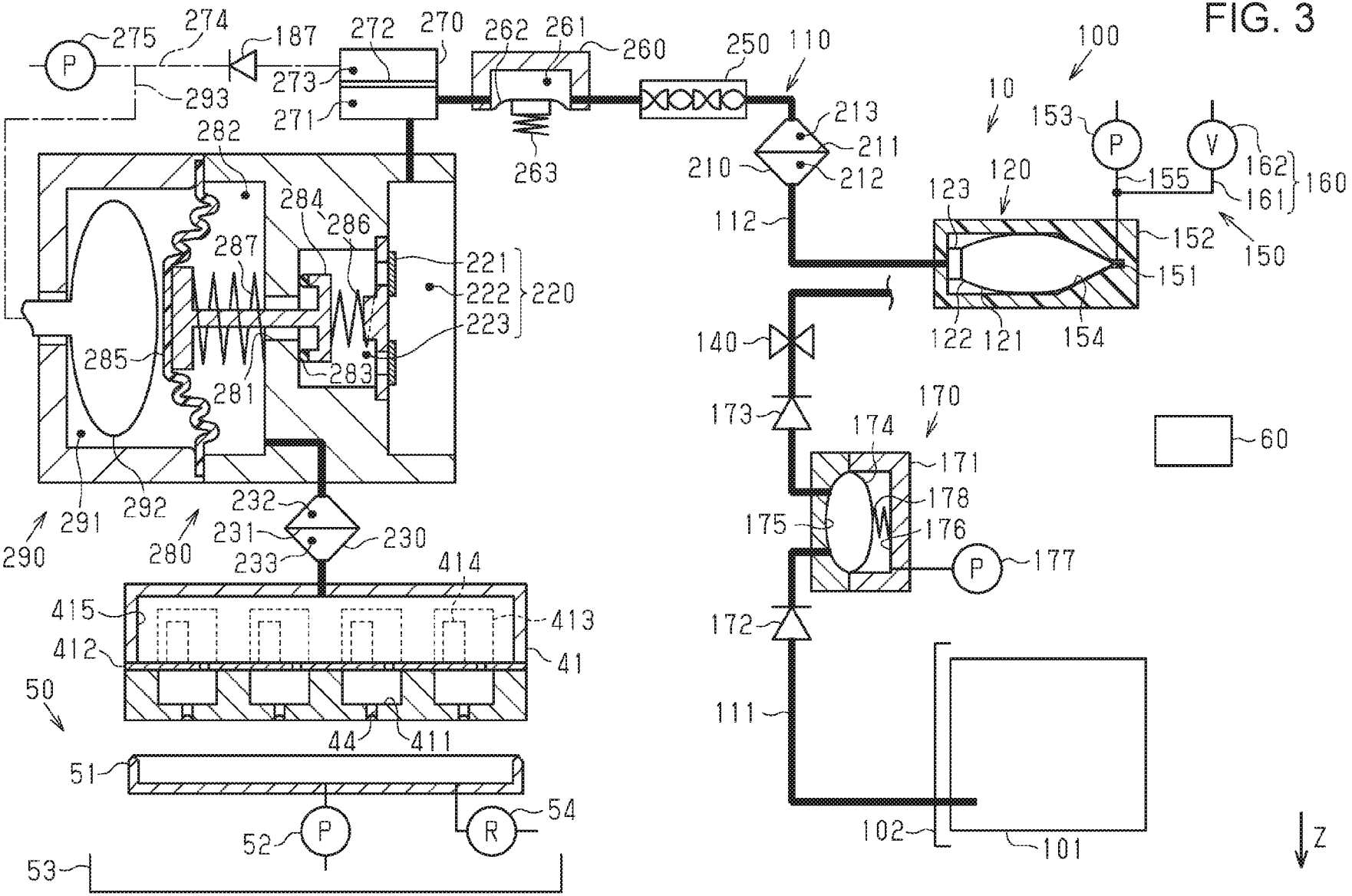
FIG. 3 is a schematic diagram illustrating a configuration of the liquid ejecting apparatus.

The liquid ejecting portion 41 includes one or a plurality of nozzles 44 that eject the liquid. The liquid ejecting portion 41 illustrated in FIGS. 2 and 3 includes a plurality of nozzles 44. As illustrated in FIG. 3, the liquid ejecting portion 41 includes individual liquid chambers 411 in communication with the nozzles 44, partitioned chambers 413 partitioned from the individual liquid chambers 411 with a diaphragm 412, and actuators 414 accommodated in the partitioned chambers 413. The liquid ejecting portion 41 includes a common liquid chamber 415 that temporality stores the supplied liquid and that supplies the liquid to the plurality of individual liquid chambers 411.

The actuators 414 are, for example, piezoelectric elements that become contracted when a drive voltage is applied thereto. When the application of the drive voltage is stopped after the diaphragm 412 is deformed with the contraction of the actuators 414, the liquid inside the individual liquid chambers 411, in which the volumes thereof have been changed, is ejected through the nozzles 44 as droplets.

The liquid ejecting apparatus 10 includes, as a configuration of the liquid supplying apparatus 100, a liquid supply flow path 110, at least one storage portion 120, an on-off valve 140, and a pressure mechanism 150. The liquid supply flow path 110 is configured to supply the liquid accommodated in a liquid supply source 101 to the liquid ejecting portion 41. The liquid supply flow path 110 couples the liquid ejecting portion 41 and the liquid supply source 101 to each other. The liquid supply source 101 is a supply source of the liquid to the liquid ejecting portion 41. The liquid supply flow path 110 is configured to include a tube, for example.

The storage portion 120 is configured to store a liquid. The storage portion 120 is provided in the liquid supply flow path 110. The storage portion 120 is, in the liquid supply flow path 110, disposed between the liquid supply source 101 and the liquid ejecting portion 41. The storage portion 120 stores the liquid supplied from the liquid supply source 101. Accordingly, the storage portion 120 is positioned downstream of the liquid supply source 101 in the direction in which the liquid is supplied.

The storage portion 120 may be formed of a flexible member 121 that has flexibility. The flexible member 121 functions as a flexible portion. In the present exemplary embodiment, the storage portion 120 includes a bag body 122 configured of the flexible member 121, and a connector 123 coupled to the liquid supply flow path 110. The liquid supplied from the liquid supply source 101 is stored inside the bag body 122 through the connector 123. The bag body 122 becomes expanded or shrunk according to the amount of the stored liquid. In other words, the volume of the storage portion 120 is changed by the expansion or shrinkage of the bag body 122.

The storage portion 120 may be configured to store a predetermined amount or more liquid while the liquid is supplied from the liquid supply source 101. In the present exemplary embodiment, when the bag body 122 is expanded to its largest size, the predetermined amount or more liquid can be stored in the storage portion 120. By so doing, even when the liquid inside the liquid supply source 101 is exhausted during printing of an image, the printing of the image can be continued by using the liquid stored in the storage portion 120. With the above, incidents such as the printing being suspended are reduced. Furthermore, a decrease in printing quality such as unevenness in color caused by interruption in printing can be suppressed.

The on-off valve 140 is configured to open/close the liquid supply flow path 110. The on-off valve 140 is provided in the liquid supply flow path 110. The on-off valve 140 is, in the liquid supply flow path 110, disposed between the storage portion 120 and the liquid supply source 101. When the on-off valve 140 is open, the flow of the liquid from the liquid supply source 101 to the storage portion 120 is allowed. When the on-off valve 140 is closed, the flow of the liquid from the liquid supply source 101 to the storage portion 120 is blocked.

For example, the on-off valve 140 may be a solenoid valve that opens/closes a valve with a solenoid or may be a motor operated valve that opens/closes a valve with an electric motor. The on-off valve 140 may be a fluid pressure valve that opens/closes a valve with a fluid pressure cylinder or may be another control valve.

The pressure mechanism 150 is configured to have pressure act on the liquid inside the storage portion 120 from the outside. The pressure mechanism 150 may be configured to have the pressure act on the storage portion 120 through the flexible member 121. The pressure mechanism 150 may shrink the bag body 122 by applying pressure to the storage portion 120 from the outside and reducing the volume of the storage portion 120.

In the present exemplary embodiment, the pressure mechanism 150 may expand the bag body 122 by reducing the pressure outside the storage portion 120 and increasing the volume of the storage portion 120. When the bag body 122 is expanded, the pressure inside the storage portion 120 becomes small. The pressure mechanism 150 has a negative pressure act on the storage portion 120 from the outside of the storage portion 120 in the above manner. The pressure mechanism 150 may be configured to apply a negative pressure to the inside of the storage portion 120 from the outside by displacing the flexible member 121 with a mechanical element such as, for example, a spring or a lever.

The storage portion 120 may be accommodated inside an accommodation portion 152. In such a case, the space in the accommodation portion 152 in which the storage portion 120 is disposed becomes an accommodation space 151. In such a case, the pressure mechanism 150 may further include a pressure pump 153 that applies pressure to the inside of the accommodation space 151. The pressure mechanism 150 makes pressure act on the storage portion 120 from the outside by applying pressure to the inside of the accommodation space 151 with the pressure pump 153. With the above, the bag body 122 of the storage portion 120 shrinks and the volume of the storage portion 120 becomes small.

Note that the pressure pump 153 may be configured to reduce the pressure of the accommodation space 151. When the pressure of the accommodation space 151 is reduced and the pressure of the accommodation space 151 becomes lower than the pressure inside the storage portion 120, a negative pressure acts on the storage portion 120 from the outside. As a result, the bag body 122 becomes expanded. In so doing, the bag body 122 comes in contact with an inner wall 154 of the accommodation portion 152 that forms the accommodation space 151. When the predetermined amount or more liquid is stored in the storage portion 120, the flexible member 121 constituting the bag body 122 comes in contact with the inner wall 154.

The pressure mechanism 150 may include a pressure controlling flow path 155 that couples the pressure pump 153 positioned outside the accommodation portion 152, and the accommodation space 151 with each other. The pressure pump 153 applies pressure to the accommodation space 151 through the pressure controlling flow path 155. The pressure pump 153 may be positioned inside the accommodation portion 152.

Furthermore, the pressure mechanism 150 may include an atmosphere communication portion 160 configured to communicate the accommodation space 151 and the atmospheric air with each other. In such a case, the atmosphere communication portion 160 includes an atmosphere communication passage 161 coupled to the pressure controlling flow path 155, and an atmosphere communication valve 162 provided in the atmosphere communication passage 161. The atmosphere communication valve 162 is of an electrically controlled type. The atmosphere communication valve 162 includes, for example, a solenoid valve. When the atmosphere communication valve 162 is closed, the accommodation space 151 is not released to the atmospheric air. On the other hand, when the atmosphere communication valve 162 is open, the accommodation space 151 is released to the atmospheric air, and the accommodation space 151 is in communication with the atmospheric air.

The liquid ejecting apparatus 10 includes a discharge mechanism 50 configured to reduce the pressure in the liquid supply flow path 110. The discharge mechanism 50 is an example of a liquid filling mechanism that fills the liquid accommodated in the liquid supply source 101 into the liquid supply flow path 110. The discharge mechanism 50 is configured to discharge the liquid inside the liquid supply flow path 110 by reducing the pressure in the liquid supply flow path 110.

In the present exemplary embodiment, the discharge mechanism 50 includes a cap 51 configured to cover the nozzles 44 of the liquid ejecting portion 41, and a suction pump 52 that suctions the inside of the cap 51. The cap 51 performs capping of the liquid ejecting portion 41 by contacting the liquid ejecting portion 41. Capping is forming a space where the nozzles 44 open. Capping is performed to suppress drying of the nozzles 44.

When the suction pump 52 is driven while the cap 51 caps the liquid ejecting portion 41, a negative pressure acts on the nozzles 44 and the liquid in the nozzles 44 is forcibly discharged. The above is referred to as suction cleaning. In other words, in the present exemplary embodiment, the discharge mechanism 50 discharges the liquid inside the liquid supply flow path 110 through the liquid ejecting portion 41 by reducing the pressure in the liquid supply flow path 110 through the liquid ejecting portion 41.

When suction cleaning is performed, air bubbles, foreign matters, and the like in the liquid ejecting portion 41 and the liquid supply flow path 110 are discharged together with the liquid. Accordingly, the discharge mechanism 50 reduces the pressure in the liquid supply flow path 110 to perform maintenance on the liquid ejecting apparatus 10.

The discharge mechanism 50 may include a waste liquid tank 53 to collect the waste liquid discharged from the liquid ejecting portion 41. By so doing, more waste liquid discharged to the cap 51 by, for example, suction cleaning can be collected in the waste liquid tank 53. The waste liquid tank 53 may directly collect the discharged waste liquid.

The discharge mechanism 50 may include a regulator 54 that controls the pressure inside the cap 51. During capping, the regulator 54 communicates the inside of the cap 51 and the atmospheric air with each other so that the pressure inside the cap 51 is at a predetermined pressure of from −2 kPa to +2 kPa, for example. In other words, by taking in air into the cap 51, the regulator 54 controls the pressure inside the cap 51 so that the pressure inside the cap is at a predetermined pressure. The regulator 54 may be an atmosphere communication valve in which the valve is closed when a negative pressure is to act on the nozzles 44, and the valve is opened when the inside of the cap 51 and the atmospheric air are to be in communication with each other.

The liquid ejecting apparatus 10 is configured to perform a maintenance operation that reduces the pressure in the liquid supply flow path 110 with the discharge mechanism 50 while the liquid supply flow path 110 is closed by the on-off valve 140. While the liquid supply flow path 110 is closed by the on-off valve 140, when the pressure of the liquid supply flow path 110 is reduced by the discharge mechanism 50, a negative pressure is accumulated in the liquid supply flow path 110 at a portion downstream of the on-off valve 140. When the negative pressure is accumulated in the liquid supply flow path 110, volumes of the air bubbles inside the liquid supply flow path 110 become larger. The above facilitates the discharge of the air bubbles inside the liquid supply flow path 110.

In the present exemplary embodiment, the liquid is discharged through the nozzles 44 by opening the on-off valve 140 while in a state in which the negative pressure has been accumulated in the liquid supply flow path 110. As described above, an operation in which the liquid inside the liquid supply flow path 110 is, after the negative pressure created by reducing the pressure in the liquid supply flow path 110 with the discharge mechanism 50 is accumulated, discharged with momentum through the nozzles 44 by the accumulated negative pressure is generally referred to as choke cleaning. Choke cleaning is executed to perform maintenance on the liquid ejecting apparatus 10. When choke cleaning is performed, air bubbles, foreign matters, and the like in the liquid ejecting portion 41 and the liquid supply flow path 110 are discharged together with the liquid. Choke cleaning is mainly performed with the aim of discharging air bubbles, foreign matters, and the like inside the liquid supply flow path 110.

In the present exemplary embodiment, when choke cleaning is performed, the liquid ejecting apparatus 10 closes the on-off valve 140 first. Subsequently, the pressure in the liquid supply flow path 110 is reduced from the liquid ejecting portion 41 side with the discharge mechanism 50. With the above, a negative pressure is accumulated in a portion of the liquid supply flow path 110 that is closer to the liquid ejecting portion 41 with respect to the on-off valve 140. In other words, a negative pressure is accumulated in the liquid supply flow path 110 in a portion downstream of the on-off valve 140. Subsequently, the on-off valve 140 is opened. As a result, owing to the pressure reduction with the discharge mechanism 50, the liquid is discharged through the nozzles 44 with momentum.

In the maintenance operation, when the pressure in the liquid supply flow path 110 is reduced by the discharge mechanism 50 while the liquid supply flow path 110 is closed by the on-off valve 140, the pressure in the storage portion 120 is also reduced. When a negative pressure acts on the storage portion 120 with the reduction in pressure with the discharge mechanism 50, there are cases in which the liquid leaks from the storage portion 120. In such a case, the liquid stored in the storage portion 120 is discharged to discharge air bubbles, foreign matters, and the like inside the liquid supply flow path 110. Accordingly, the amount of liquid consumed during maintenance becomes large.

When the liquid flows out from the storage portion 120 due to the reduction in pressure with the discharge mechanism 50, it will be difficult to accumulate the negative pressure in the liquid supply flow path 110. In particular, in a case in which the storage portion 120 is formed of the flexible member 121, when the reduction in pressure with the discharge mechanism 50 acts on the storage portion 120, the flexible member 121 becomes displaced so that the volume of the storage portion 120 becomes small. In such a case, when accumulating a sufficient amount of negative pressure in the liquid supply flow path 110, since the flexible member 121 becomes displaced, a majority of the liquid inside the storage portion 120 flows to the outside. In other words, when choke cleaning is performed in the above state, a majority of the liquid stored in the storage portion 120 is discharged, and the consumed amount of liquid tends to become large.

During the maintenance operation, the liquid ejecting apparatus 10 operates so that the consumed amount of liquid is reduced. During the maintenance operation, the control portion 60 controls the pressure mechanism 150 so that a negative pressure that is equivalent to or larger than the negative pressure acting on the storage portion 120 with the reduction in pressure with the discharge mechanism 50 acts on the storage portion 120. In the above operation, the negative pressure acting on the storage portion 120 due to the reduction in pressure with the discharge mechanism 50 is, for example, −50 kPa with respect to the atmospheric pressure. During the maintenance operation, the control portion 60 controls the pressure mechanism 150 so that, as the negative pressure that is at least −50 kPa, a negative pressure of −60 kPa, for example, acts on the storage portion 120. In other words, the pressure mechanism 150 makes pressure, which is smaller than the pressure acting on the storage portion 120 with the reduction in pressure with the discharge mechanism 50, act inside the storage portion 120 from the outside. By so doing, incidents such as the liquid flowing out from the storage portion 120 due to the reduction in pressure with the discharge mechanism 50 can be reduced.

In the present exemplary embodiment, the pressure mechanism 150 makes the negative pressure act on the storage portion 120 from the outside during the maintenance operation so that the flexible member 121 does not become displaced with the reduction in pressure with the discharge mechanism 50. For example, the pressure mechanism 150 reduces the pressure of the accommodation space 151 during the maintenance operation so that the flexible member 121 comes in contact with the inner wall 154 of the accommodation portion 152. By so doing, the amount of liquid stored in the storage portion 120 during the maintenance operation can be maintained at the predetermined value or more.

The liquid supplying apparatus 100 of the present exemplary embodiment will be described next.

The liquid supplying apparatus 100 includes a holding portion 102 configured to attach/detach the liquid supply source 101 accommodating the liquid. The liquid supply flow path 110 is configured to supply the liquid to the liquid ejecting portion 41 from the liquid supply source 101 mounted on the holding portion 102.

The liquid supply source 101 may be configured in any manner that allows the liquid to be accommodated therein and may be, for example, of a replaceable cartridge type or of a tank type to which liquid can be refilled. The liquid supply source 101 is provided so that the number thereof corresponds to the number of types of liquid used in the liquid ejecting apparatus 10.

In the present exemplary embodiment, the liquid supply flow path 110 includes a first liquid flow path 111 and a second liquid flow path 112. The first liquid flow path 111 couples the liquid supply source 101 mounted on the holding portion 102 and the storage portion 120 with each other. The second liquid flow path 112 couples the storage portion 120 and the liquid ejecting portion 41 with each other. The first liquid flow path 111 and the second liquid flow path 112 are coupled to the connector 123 of the storage portion 120.

The liquid supply flow path 110 may be any flow path through which a liquid can flow. The liquid supply flow path 110 may be formed of an elastically deformable tube or may be formed of a flow path forming member formed of a hard resin material, for example. The liquid supply flow path 110 may be formed by adhering a film member on a flow path forming member in which a groove has been formed.

The liquid supplying apparatus 100 may include a feed pump mechanism 170 that supplies the liquid towards the liquid ejecting portion 41. The feed pump mechanism 170 is an example of a liquid filling mechanism that fills the liquid accommodated in the liquid supply source 101 into the liquid supply flow path 110. The feed pump mechanism 170 applies pressure to the liquid inside the liquid supply source 101 to a supply pressure that enables the liquid to be ejected through the nozzles 44. The feed pump mechanism 170 is configured to supply the liquid, to which the pressure has been applied, towards the liquid ejecting portion 41 through the liquid supply flow path 110.

The feed pump mechanism 170 is provided in the liquid supply flow path 110. The feed pump mechanism 170 is, in the liquid supply flow path 110, positioned between the liquid supply source 101 and the storage portion 120. Accordingly, the storage portion 120 stores the liquid to which the pressure has been applied with the feed pump mechanism 170. In the present exemplary embodiment, the feed pump mechanism 170 is provided in the first liquid flow path 111. The liquid in the liquid supply source 101 is supplied to the liquid ejecting portion 41 through the storage portion 120 with the feed pump mechanism 170.

In the present exemplary embodiment, the feed pump mechanism 170 includes a volumetric pump 171, a first regulating valve 172, and a second regulating valve 173. The first regulating valve 172 is positioned upstream of the volumetric pump 171 in the liquid supply flow path 110. The second regulating valve 173 is positioned downstream of the volumetric pump 171 in the liquid supply flow path 110. Specifically, the second regulating valve 173 is, in the liquid supply flow path 110, positioned between the volumetric pump 171 and the on-off valve 140. In the present exemplary embodiment, the first regulating valve 172 and the second regulating valve 173 are one-way valves that permit the upstream to downstream flow of the liquid in the liquid supply flow path 110 and that restrict the downstream to upstream flow of the liquid. The first regulating valve 172 and the second regulating valve 173 are, in the liquid supply flow path 110, provided between the storage portion 120 and the liquid supply source 101, and restrict the liquid to flow from the storage portion 120 towards the liquid supply source 101. Similar to the on-off valve 140, the first regulating valve 172 and the second regulating valve 173 may be configured to open/close the liquid supply flow path 110.

The volumetric pump 171 is configured to apply pressure to the liquid by reciprocating a flexible film 174 having flexibility. The volumetric pump 171 includes a pump chamber 175 and a negative-pressure chamber 176 that are separated from each other with the flexible film 174. The volumetric pump 171 includes a pressure reducing portion 177 that reduces the pressure in the negative-pressure chamber 176, and an urging member 178 that urges the flexible film 174 in a direction that reduces the volume of the pump chamber 175. The urging member 178 is provided inside the negative-pressure chamber 176.

When the pressure reducing portion 177 reduces the pressure in the negative-pressure chamber 176, the flexible film 174 is displaced so that the volume of the pump chamber 175 becomes larger. When the volume of the pump chamber 175 becomes larger, the liquid is drawn into the pump chamber 175 from the liquid supply source 101. When the reducing of pressure in the negative-pressure chamber 176 with the pressure reducing portion 177 is stopped and the pressure in the negative-pressure chamber 176 is increased, the flexible film 174 is urged by the urging member 178 and the pump chamber 175 is displaced so that the volume thereof is reduced. When the volume of the pump chamber 175 is reduced, the liquid is pushed out from the pump chamber 175. In other words, in the present exemplary embodiment, the volumetric pump 171 is configured of a diaphragm pump.

The feed pump mechanism 170 applies pressure to the liquid by having the urging member 178 urge the liquid in the pump chamber 175 through the flexible film 174. With the above, the feed pump mechanism 170 supplies the liquid towards the liquid ejecting portion 41. The pressure applying force of the feed pump mechanism 170 that applies pressure to the liquid is set by the urging force of the urging member 178.

The liquid supplying apparatus 100 may include a first filter portion 210, a second filter portion 220, a third filter portion 230, a static mixer 250, a liquid storage portion 260, a deaerator mechanism 270, and a liquid pressure control mechanism 280. The first filter portion 210, the second filter portion 220, the third filter portion 230, the static mixer 250, the liquid storage portion 260, the deaerator mechanism 270, and the liquid pressure control mechanism 280 are provided in the liquid supply flow path 110 and are positioned between the storage portion 120 and the liquid ejecting portion 41. In the present exemplary embodiment, in order from the upstream side, the first filter portion 210, the static mixer 250, the liquid storage portion 260, the deaerator mechanism 270, the second filter portion 220, the liquid pressure control mechanism 280, and the third filter portion 230 are provided in the second liquid flow path 112.

As the use time increases, foreign matters collected in the first filter portion 210, the second filter portion 220, and the third filter portion 230 increase. Accordingly, the liquid ejecting apparatus 10 may be configured so that at least one of the first filter portion 210, the second filter portion 220, and the third filter portion 230 is replaceable. For example, as illustrated in FIG. 2, the first filter portion 210 may be provided at a position where the first filter portion 210 becomes exposed from the housing 12 when a cover 18 of the housing 12 is open.

As illustrated in FIG. 3, the first filter portion 210 includes a first filter 211 that collects foreign matters, a first upstream filter chamber 212 positioned upstream of the first filter 211, and a first downstream filter chamber 213 positioned downstream of the first filter 211. The first upstream filter chamber 212 is positioned below the first downstream filter chamber 213. The first upstream filter chamber 212 is provided in a substantially conical shape or in a substantially truncated cone shape. The first filter 211 is formed in a substantially disk shape so as to constitute a bottom surface of the first upstream filter chamber 212. A height of the first upstream filter chamber 212 may be smaller than a diameter of the first filter 211.

The second filter portion 220 includes a second filter 221 that collects foreign matters, a second upstream filter chamber 222 positioned upstream of the second filter 221, and a second downstream filter chamber 223 positioned downstream of the second filter 221.

The third filter portion 230 includes a third filter 231 that collects foreign matters, a third upstream filter chamber 232 positioned upstream of the third filter 231, and a third downstream filter chamber 233 positioned downstream of the third filter 231.

Filtration areas of the first filter 211, the second filter 221, and the third filter 231 through which the liquid can pass may be formed larger than the flow-path cross-sectional area of the liquid supply flow path 110. For example, a meshed body, a porous body, a perforated plate in which minute through holes are formed, and the like can be used as the first filter 211, the second filter 221, and the third filter 231. The first filter 211, the second filter 221, and the third filter 231 may use filters of different types and shapes.

A filter of a meshed body includes wire netting, a resin net, a mesh filter, and metal fiber. A filter of metal fiber includes a felt filter, which is a stainless steel fine wire formed in a felt-like manner, and a metallic sintered filter, which is a stainless steel fine wire that has been compressed and sintered. A filter of a perforated plate includes an electroforming metal filter, an electron beam processing metal filter, and a laser beam machining metal filter.

The static mixer 250 includes a plurality of configurations that split the flow of the liquid in a direction in which the liquid flows. The static mixer 250 divides, switches, and inverts the liquid flowing through the static mixer 250 to reduce the bias in the concentration of the liquid.

The liquid storage portion 260 includes a pressure applying chamber 261 that stores the liquid, an elastic film 262 that constitutes a portion of the wall surface of the pressure applying chamber 261, and a first urging member 263 that urges the elastic film 262 in a direction that reduces the volume of the pressure applying chamber 261. Pressure is applied to the liquid stored in the pressure applying chamber 261 with the first urging member 263.

The liquid storage portion 260 applies pressure to the liquid stored in the pressure applying chamber 261 at a pressure that is lower than the supply pressure, which is the pressure applied by the feed pump mechanism 170 when the liquid is supplied to the liquid ejecting portion 41. The supply pressure, which is the pressure applied by the feed pump mechanism 170 when the liquid is supplied to the liquid ejecting portion 41, is 30 kPa, for example. Accordingly, the liquid storage portion 260 applies a pressure of 10 kPa, for example, to the liquid stored in the pressure applying chamber 261. Specifically, the pressure acting on the liquid stored in the pressure applying chamber 261 by urging the elastic film 262 with the first urging member 263 is lower than the pressure made to act on the liquid with the feed pump mechanism 170 to supply the liquid from the liquid supply source 101 towards the liquid ejecting portion 41. Accordingly, when the supply pressure of the liquid from the liquid supply source 101 up to the liquid storage portion 260 has not decreased, the elastic film 262 countering the urging force of the first urging member 263 is displaced in a direction in which the volume of the pressure applying chamber 261 becomes large.

The deaerator mechanism 270 includes a deaerator chamber 271 in which the liquid is temporarily stored, an exhaust chamber 273 partitioned from the deaerator chamber 271 with a deaerating film 272, and an exhaust passage 274 that communicates the exhaust chamber 273 to the outside.

The deaerating film 272 has a property of not passing a liquid therethrough while passing gas therethrough. For example, a film fabricated by performing a special stretching processing on polytetrafluoroethylene and by forming a plurality of minute holes of about 0.2 micrometers therein can be adopted as the deaerating film 272. When the liquid containing gas flows into the deaerator chamber 271, the gas alone passes through the deaerating film 272 and enters the exhaust chamber 273. The gas that has entered the exhaust chamber 273 is discharged to the outside through the exhaust passage 274. With the above, the air bubbles and dissolved gas mixed in the liquid stored in the deaerator chamber 271 are removed.

In the deaerator mechanism 270, the exhaust chamber 273 may be positioned above the deaerator chamber 271. The air bubbles and the dissolved gas mixed in the liquid tend to float up through the liquid. Accordingly, when the exhaust chamber 273 is positioned above the deaerator chamber 271, removing of the air bubbles and the dissolved gas mixed in the liquid is facilitated.

The deaerator mechanism 270 may include a pressure reducing pump 275 that reduces the pressure in the exhaust chamber 273. By reducing the pressure in the exhaust chamber 273 through the exhaust passage 274, the pressure reducing pump 275 removes the air bubbles and the dissolved gas mixed in the liquid stored in the deaerator chamber 271. The pressure reducing pump 275 does not have to be provided when the pressure in the exhaust chamber 273 can be made lower than the pressure in the deaerator chamber 271 by using a member such as a spring, for example. In the present exemplary embodiment, the pressure in the deaerator chamber 271 is set higher than the pressure in the exhaust chamber 273 by applying pressure with the feed pump mechanism 170.

In the present exemplary embodiment, the liquid pressure control mechanism 280 is, at a position downstream of the second filter portion 220, provided integrally with the second filter portion 220. The liquid pressure control mechanism 280 includes a liquid chamber 282 that is in communication with the second downstream filter chamber 223 through a communication hole 281, and a valve body 283 configured to open/close the communication hole 281. The valve body 283 is an example of a pressure control valve. The liquid pressure control mechanism 280 includes a pressure receiving member 284 in which a base end side is accommodated in the second downstream filter chamber 223 and in which a front end side is accommodated in the liquid chamber 282.

The liquid chamber 282 of the liquid pressure control mechanism 280 is configured to store a liquid. A portion of a wall surface of the liquid chamber 282 is formed of a flexible wall 285 configured to become flexed and displaced. It is only sufficient that the valve body 283 is an elastic body such as, for example, rubber or a resin attached to a base end portion of the pressure receiving member 284 positioned inside the second downstream filter chamber 223.

The liquid pressure control mechanism 280 includes a second urging member 286 accommodated in the second downstream filter chamber 223, and a third urging member 287 accommodated in the liquid chamber 282. The second urging member 286 urges the valve body 283 through the pressure receiving member 284 in a direction in which the communication hole 281 is closed. When the flexible wall 285 pushes the pressure receiving member 284 by becoming flexed and displaced in a direction that reduces the volume of the liquid chamber 282, the third urging member 287 pushes back the pressure receiving member 284.

Due to a decrease in internal pressure of the liquid chamber 282, when the force of the flexible wall 285 pushing the pressure receiving member 284 exceeds the urging forces of the second urging member 286 and the third urging member 287, the valve body 283 opens the communication hole 281. Due to the communication hole 281 being opened, when the liquid flows into the liquid chamber 282 from the second downstream filter chamber 223, the internal pressure of the liquid chamber 282 increases. As a result, the valve body 283 closes the communication hole 281 with the urging forces of the second urging member 286 and the third urging member 287 before the internal pressure of the liquid chamber 282 increases to a positive pressure. The internal pressure of the liquid chamber 282 is maintained in a range of the negative pressure in accordance with the urging forces of the second urging member 286 and the third urging member 287.

The internal pressure of the liquid chamber 282 decreases as the liquid is discharged from the liquid ejecting portion 41. The valve body 283 autonomously opens/closes the communication hole 281 according to a difference between the atmospheric pressure, which is the external pressure of the liquid chamber 282, and the internal pressure of the liquid chamber 282. In other words, the valve body 283 serving as the pressure control valve is a differential pressure valve that opens when a flow path pressure, which is a pressure in the liquid supply flow path 110 between the valve body 283 and the liquid ejecting portion 41, is lower than the outside air pressure and when the difference between the flow path pressure and the outside air pressure is equivalent to or larger than a set value. The differential pressure valve is also called a pressure reducing valve or a self-sealing valve. The liquid pressure control mechanism 280 controls the pressure of the liquid supplied to the liquid ejecting portion 41 to a controlled pressure that allows the liquid to be ejected through the nozzles 44 and that is lower than the supply pressure. The controlled pressure is −1 kPa, for example.

A valve opening mechanism 290 that supplies the liquid to the liquid ejecting portion 41 by forcibly opening the communication hole 281 may be added to the liquid pressure control mechanism 280. For example, the valve opening mechanism 290 includes a pressure application bag 292 accommodated in an accommodation chamber 291 partitioned from the liquid chamber 282 by the flexible wall 285, and a pressure application flow path 293 through which gas is made to flow into the pressure application bag 292.

The valve opening mechanism 290 forcibly opens the communication hole 281 by having the pressure application bag 292 become inflated by the gas flowing therein through the pressure application flow path 293 and by having the flexible wall 285 become flexed and displaced in a direction that reduces the volume of the liquid chamber 282. The liquid supplying apparatus 100 can perform pressure applying cleaning in which the liquid is made to flow out from the liquid ejecting portion 41 by applying pressure to and supplying the liquid to the liquid ejecting portion 41 from the liquid supply source 101 while the communication hole 281 is open.

When the liquid supplying apparatus 100 includes the pressure reducing pump 275, the liquid supplying apparatus 100 may be configured to have the valve opening mechanism 290 and the deaerator mechanism 270 share the pressure reducing pump 275. For example, the pressure application flow path 293 and the exhaust passage 274 may be coupled to each other and the pressure reducing pump 275 may be configured to be driven for both increasing pressure and decreasing pressure. In such a case, a check valve 187 may be provided in the exhaust passage 274. In such a configuration, the gas may be fed to the pressure application bag 292 by driving the pressure reducing pump 275 so that the pressure is applied, and the pressure of the exhaust chamber 273 may be reduced by driving the pressure reducing pump 275 so that the pressure is reduced.

The storage portion 120 and the pressure mechanism 150 will be described next.

The storage portion 120 is provided so that the number thereof corresponds to the number of liquid supply sources 101. In other words, the storage portion 120 is provided so the number thereof corresponds to the number of types of liquid used in the liquid ejecting apparatus 10. For example, a single storage portion 120 may be provided for a single liquid supply source 101, or two storage portions 120 may be provided for a single liquid supply source 101.

Figure 4:
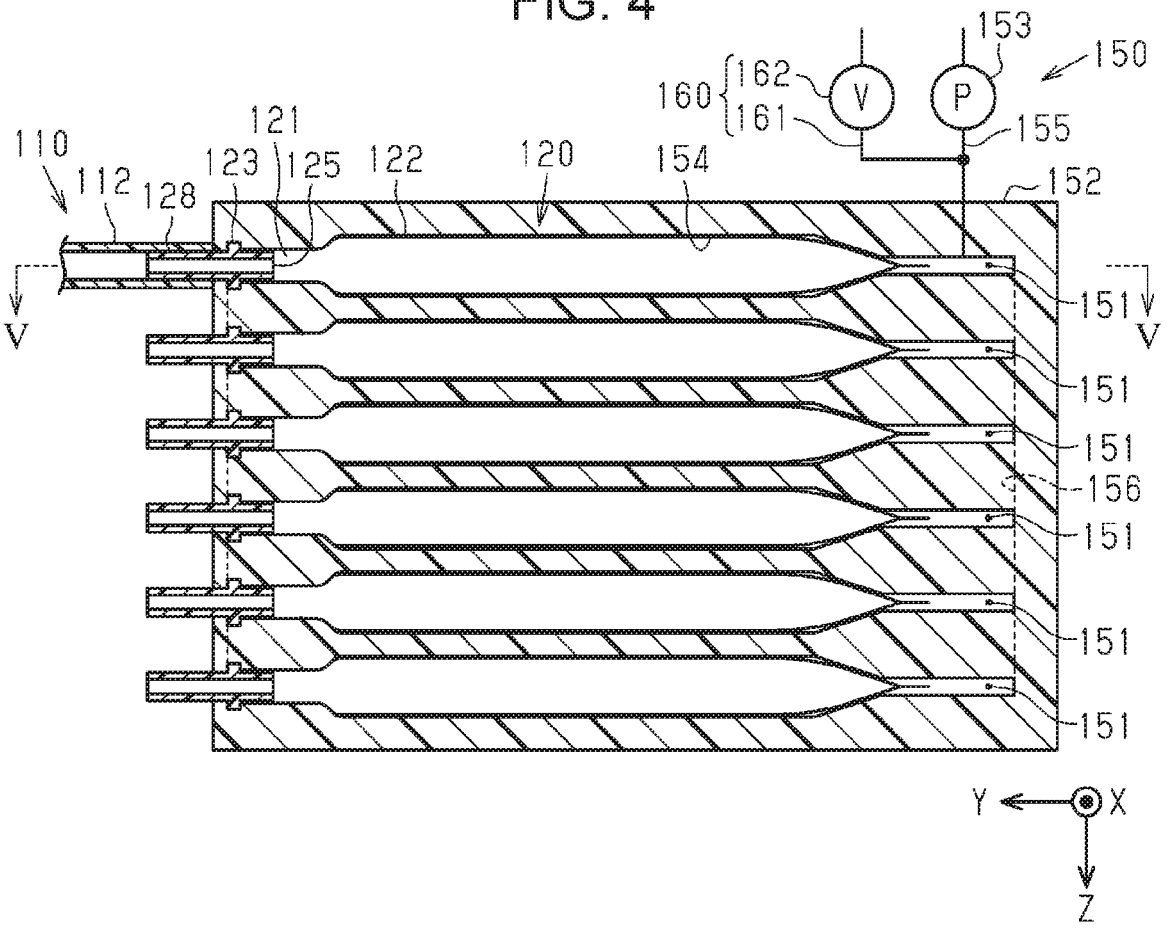
FIG. 4 is a cross-sectional view illustrating storage portions and a pressure mechanism constituting the liquid ejecting apparatus.

As illustrated in FIG. 4, a plurality of storage portions 120 are provided in the present exemplary embodiment. A plurality of accommodation spaces 151 are formed in the accommodation portion 152 of the pressure mechanism 150. Accordingly, the accommodation portion 152 is configured to accommodate the plurality of storage portions 120. The accommodation portion 152 may be configured to include a single accommodation space 151. In such a case, a plurality of accommodation portions 152 are provided so as to correspond to the plurality of storage portions 120.

The plurality of accommodation spaces 151 are positioned in the accommodation portion 152 so as to be arranged in the vertical direction. In the present exemplary embodiment, six accommodation spaces 151 are formed in the accommodation portion 152. In other words, the accommodation portion 152 is configured to accommodate six storage portions 120.

The plurality of accommodation spaces 151 are in communication with each other through a slit 156 provided in the accommodation portion 152. Accordingly, when the pressure of one accommodation space 151 is reduced, the pressures of the other accommodation spaces 151 are reduced as well. When the pressure of one accommodation space 151 is increased, the pressures of the other accommodation spaces 151 are increased as well. The pressure mechanism 150 may include the pressure pump 153 and the atmosphere communication portion 160 in each of the accommodation spaces 151. In such a case, when the plurality of accommodation spaces 151 are not in communication with each other, the control of the pressure can be performed per each accommodation space 151. The pressure mechanism 150 increases the pressures inside the storage portions 120 by having the pressure pump 153 feed gas into the accommodation spaces 151 of the accommodation portion 152. The atmosphere communication portion 160 makes the pressures inside the storage portions 120 equal to the atmospheric pressure by opening the atmosphere communication valve 162.

Inner walls 154 of the accommodation portion 152 that form the accommodation spaces 151 can be disposed so as to be in contact with the flexible members 121 that have been displaced to increase the volume of the storage portions 120. The above configuration can suppress the flexible members 121 from becoming excessively displaced. In other words, the bag bodies 122 can be suppressed from becoming excessively inflated. With the above, damages in the flexible members 121 due to excessive displacement can be reduced.

Figure 5:
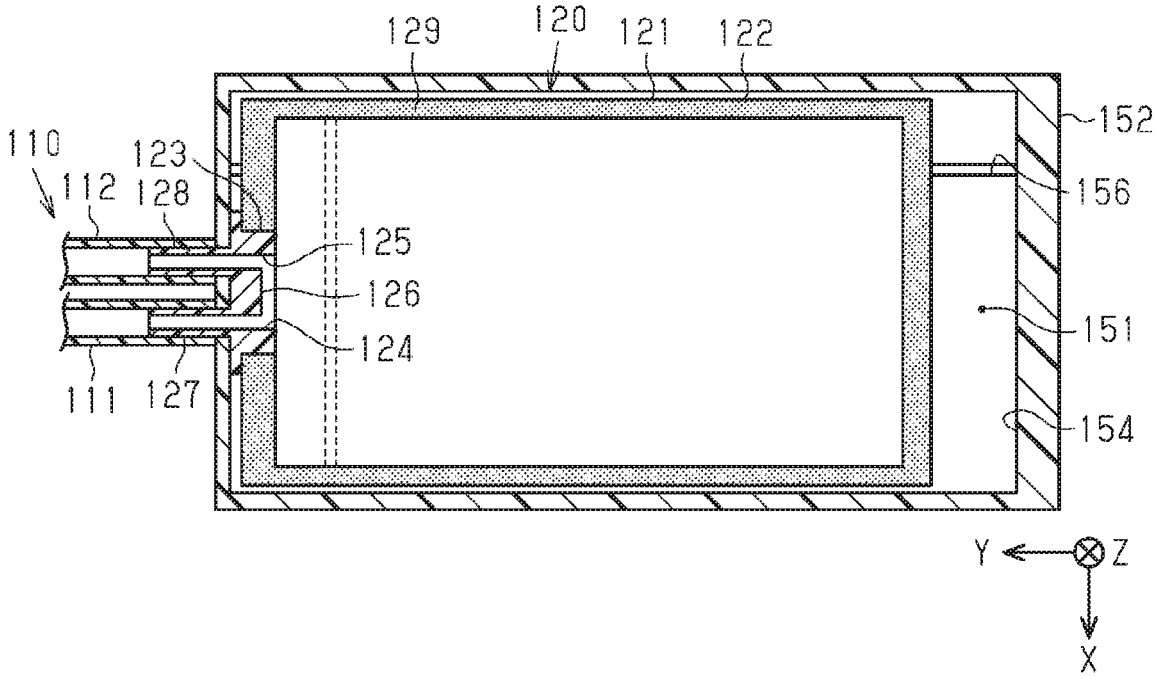
FIG. 5 is a cross-sectional view cut along line V-V in FIG. 4.

As illustrated in FIG. 5, an introducing hole 124 that introduces the liquid into the storage portion 120, and a delivering hole 125 that delivers the liquid to the outside of the storage portion 120 may be provided in the connector 123 of the storage portion 120. The introducing hole 124 and the delivering hole 125 of the present exemplary embodiment are provided in the connector 123 and are open in the bag body 122. The liquid introduced through the introducing hole 124 passes through the storage portion 120 and is delivered through the delivering hole 125.

A connection passage 126 that couples the introducing hole 124 and the delivering hole 125 to each other may further be provided in the connector 123. By so doing, even when the bag body 122 is totally shrunk, the liquid can be made to flow from the introducing hole 124 to the delivering hole 125 through the connection passage 126.

The storage portion 120 may include an introducing pipe 127 coupled to the first liquid flow path 111, and a delivering pipe 128 coupled to the second liquid flow path 112. The introducing pipe 127 and the delivering pipe 128 of the present exemplary embodiment are provided in the connector 123. The introducing hole 124 opens at one end of the introducing pipe 127. The delivering hole 125 opens at the one end of the delivering pipe 128. The introducing pipe 127 and the delivering pipe 128 may be provided independently.

The bag body 122 may be formed by adhering two flexible members 121 to each other. The flexible member 121 is provided in the form of a rectangular sheet, for example. Edge portions of the flexible members 121 are adhesive portions 129, which are where the flexible members 121 are adhered to each other. The flexible members 121 may be adhered to each other with an adhesive agent or may be welded to each other by heat or with a solvent. The connector 123 is positioned so as to be interposed between the adhesive portions 129 and are adhered to the adhesive portions 129.

In the present exemplary embodiment, the flat bag body 122 is disposed so as to be horizontally mounted flat on a plane defined by the X-axis and the Y-axis. The bag body 122 may be disposed so as to be vertically mounted flat on a plane defined by the Y-axis and the Z-axis, or may be vertically mounted flat on a plane defined by the Z-axis and the X-axis.

Referring next to a flowchart in FIG. 6, a method of filling the liquid in the liquid ejecting apparatus 10 will be described. The filling method is a method of filling the liquid in the liquid supply flow path 110 during initial filling. In the present exemplary embodiment, processes constituting the filling method are each executed by the control portion 60. Note that the "initial filling" herein is a sequence of processes that fills the liquid inside the liquid supply source 101 into the liquid supply flow path 110 when in an initial state that is a state in which there is no liquid in the liquid supply flow path 110. The sequence of processes illustrated in FIG. 6 is executed with a trigger such as the liquid supply source 101 being mounted on the holding portion 102 while in the initial state, or the liquid being filled in the empty liquid supply source 101 mounted on the holding portion 102.

Figure 6:
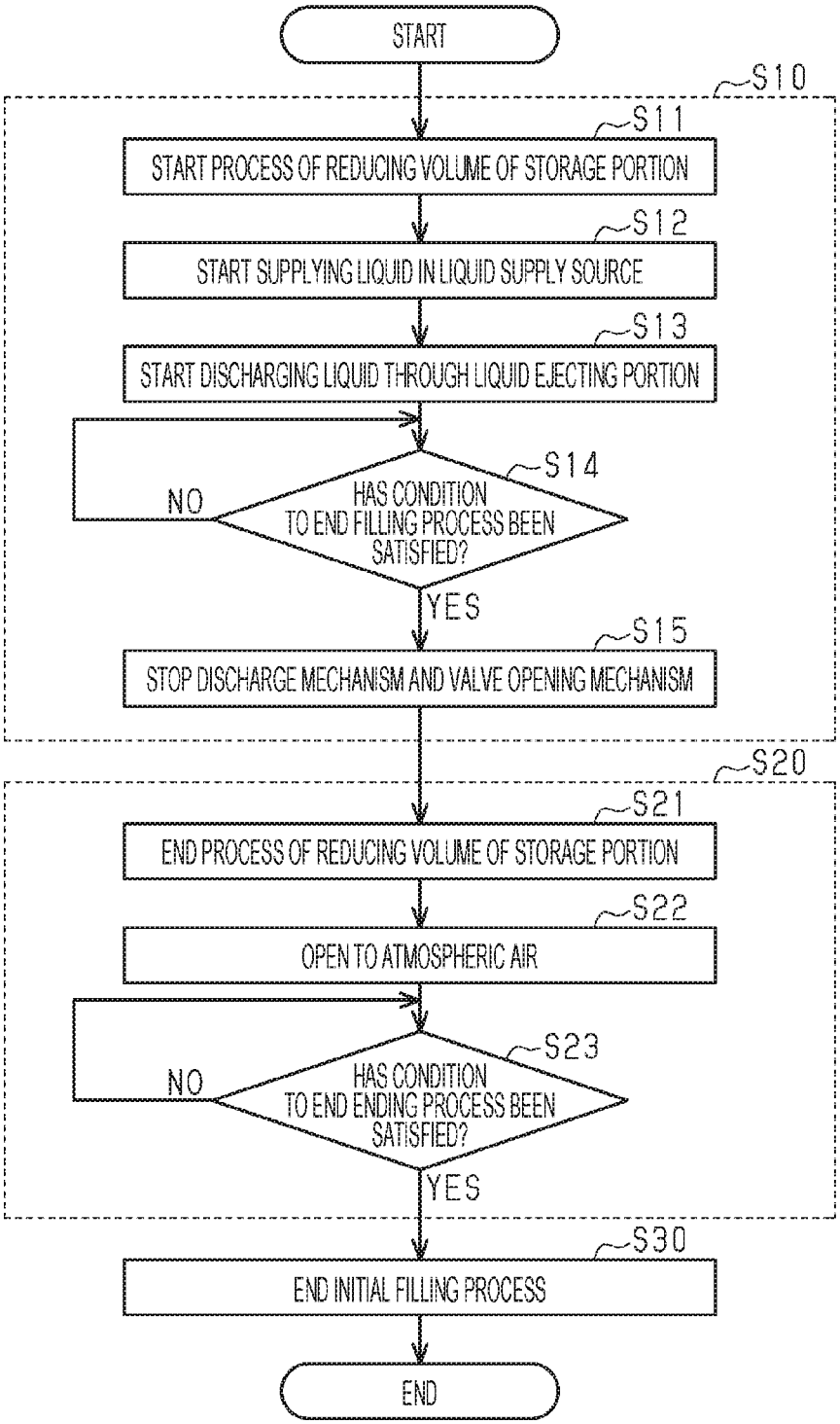
FIG. 6 is a flowchart describing a procedure of processes in the liquid ejecting apparatus.

As illustrated in FIG. 6, when a condition to execute the filling method of the present exemplary embodiment is satisfied, the control portion 60 executes a filling process S10, and executes an ending process S20 after executing the filling process S10. The filling process S10 is a process of filling the liquid in the liquid supply flow path 110 while in a state in which pressure is made to act on the bag body 122 so that the volume of the storage portion 120 is smaller than when the pressure is not made to act on the bag body 122. The ending process S20 is a process of ending the state in which the pressure is made to act on the bag body 122.

In step S11, which is the first step in the filling process S10, the control portion 60 starts a process of reducing the volume of the storage portion 120. In other words, the control portion 60 opens the liquid pressure control mechanism 280 with the valve opening mechanism 290 and makes the pressure act on the bag body 122 of the storage portion 120 with the pressure mechanism 150. For example, the control portion 60 dives the pressure pump 153 to apply pressure to the accommodation space 151 of the accommodation portion 152 while the atmosphere communication valve 162 of the atmosphere communication portion 160 is in a closed state. Since the pressure of the accommodation space 151 is increased with the above, pressure acts on the bag body 122 from the outside. With the above, since the pressure outside the storage portion 120 becomes higher than the pressure inside the storage portion 120, the bag body 122 is deformed so that the volume of the storage portion 120 is decreased. Subsequently, when it is determined that the volume of the storage portion 120 is smaller than a predetermined volume, the control portion 60 moves the process to the next step S12. For example, it can be determined that the volume of the storage portion 120 has become smaller than the predetermined volume under the condition that the time that has passed has reached a specified time since the drive of the pressure pump 153 has been started.

A volume of the storage portion 120 when the opposing portions in the bag body 122 of the storage portion 120 come in contact with each other is set as the predetermined volume. For example, when the bag body 122 is configured by adhering peripheries of two flexible members 121 to each other, the predetermined volume may be set as a volume when at least a portion of a portion inside the periphery of one of the flexible member 121 is in contact with a portion of the other flexible member 121 that is inside the periphery, or may be set as a volume that is smaller than the above volume. When the predetermined volume is set in the above manner, when the process is moved to step S12, a state is reached in which there is almost no air inside the storage portion 120.

In step S12, the control portion 60 starts supplying the liquid in the liquid supply source 101. In other words, the control portion 60 drives the feed pump mechanism 170 to make the liquid flow out from the liquid supply source 101 to the liquid supply flow path 110. Subsequently, in step S13, the control portion 60 starts discharging the liquid in the liquid supply flow path 110 to the outside through the liquid ejecting portion 41. In other words, by driving the discharge mechanism 50, the control portion 60 discharges the air inside the liquid supply flow path 110 into the cap 51 through the nozzles 44 of the liquid ejecting portion 41. For example, the control portion 60 makes the cap 51 cap the liquid ejecting portion 41 and, in such a state, drives the suction pump 52.

Note that in the example illustrated in FIG. 6, the drive of the feed pump mechanism 170 is started before the drive of the discharge mechanism 50. However, the order in which the driving is started is not an issue as long as the liquid can be filled in the liquid supply flow path 110 by driving the feed pump mechanism 170 and the discharge mechanism 50. For example, if a driving period of the feed pump mechanism 170 and a driving period of the discharge mechanism 50 can be made to temporally overlap each other, the drive of the discharge mechanism 50 may be started before the drive of the feed pump mechanism 170. In such a case, since the liquid pressure control mechanism 280 is opened by the drive of the discharge mechanism 50, the valve opening mechanism 290 does not have to be driven. Alternatively, the drive of the discharge mechanism 50 and the drive of the feed pump mechanism 170 may be started at the same time.

Subsequently, in step S14, the control portion 60 determines whether a condition of ending the filling process S10 has been satisfied. In other words, the control portion 60 determines that the condition to end is satisfied when it is determined that the liquid supply flow path 110 is filled with the liquid that has flowed out from the liquid supply source 101 to the liquid supply flow path 110. For example, the control portion 60 determines that the liquid supply flow path 110 is filled with the liquid that has flowed out from the liquid supply source 101 to the liquid supply flow path 110 when the time that has passed since the filling process S10 has been started is equivalent to or longer than a predetermined determination time. For example, a time in proportion to the shape of the liquid supply flow path 110, the capacities of the mechanisms 50, 150, and 170 can be set as the predetermined determination time.

For example, when it is determined that the liquid is filled from an upstream end of the liquid supply flow path 110 to the inside of the nozzles 44, it can be determined that the liquid supply flow path 110 is filled with the liquid.

In step S14, if the condition to end the filling process S10 has not yet been satisfied (S14: NO), the control portion 60 repeats the determination process of step S14. In other words, the control portion 60 continues the filling process S10. On the other hand, if the condition to end is satisfied (S14: YES), the control portion 60 moves the process to the next step S15. In step S15, the control portion 60 stops the drive of the discharge mechanism 50 and the drive of the valve opening mechanism 290. Subsequently, the control portion 60 ends the filling process S10.

The control portion 60 executes the ending process S20 after the filling process S10 has been ended. In the first step S21 of the ending process S20, the control portion 60 ends the process of reducing the volume of the storage portion 120 started in step S11. In other words, the control portion 60 stops the drive of the pressure pump 153 of the pressure mechanism 150. With the above, the increase in the pressure in the accommodation space 151 of the accommodation portion 152 is stopped. Subsequently, in the next step S22, the control portion 60 opens the accommodation space 151 to the atmospheric air. In other words, the control portion 60 communicates the accommodation space 151 and the atmospheric air with each other by driving the atmosphere communication portion 160 of the pressure mechanism 150. For example, the control portion 60 opens the atmosphere communication valve 162 of the atmosphere communication portion 160. With the above, the pressure in the accommodation space 151 is reduced to the atmospheric pressure.

Note that even when the filling process S10 is ended and the ending process S20 is started, the control portion 60 continues the drive of the feed pump mechanism 170. Accordingly, when the state in which the pressure acts on the bag body 122 of the storage portion 120 is ended, the liquid discharged from the feed pump mechanism 170 flows into the storage portion 120.

Subsequently, in step S23 the control portion 60 determines whether a condition of ending the ending process S20 has been satisfied. For example, the control portion 60 determines that the condition to end is satisfied when the time that has passed since the time when the process of step S22 has been started is equivalent to or longer than a predetermined end determination time.

Note that the speed at which the pressure of the accommodation space 151 is decreased by the atmosphere communication portion 160 and the amount of liquid discharged with the feed pump mechanism 170 can be known in advance. Furthermore, as the speed at which the pressure of the accommodation space 151 decreases becomes larger, the speed at which the amount of liquid inside the storage portion 120 increases becomes larger. Furthermore, as the amount of liquid discharged with the feed pump mechanism 170 becomes larger, the speed at which the amount of liquid inside the storage portion 120 increases becomes larger. Accordingly, for example, an executing time of the ending process S20 at which the amount of increase in the liquid inside the storage portion 120 with the execution of the ending process S20 is estimated to reach a predetermined increase amount, or a time slightly longer than the executing time is set as the predetermined end determination time.

In step S23, if the condition to end the ending process S20 has not yet been satisfied (S23: NO), the control portion 60 repeats the determination process of step S23. In other words, the control portion 60 continues the ending process S20. On the other hand, if the condition to end is satisfied (S23: YES), the control portion 60 ends the ending process S20.

Subsequently, in the next step S30, the control portion 60 ends the sequential initial filling process. In other words, the control portion 60 stops the drive of the feed pump mechanism 170.

Functions of the present exemplary embodiment will be described next.

The sequential initial filling process illustrated in FIG. 6 is started when the liquid supply source 101 is mounted on the holding portion 102 or when the liquid is filled in the liquid supply source 101 mounted on the holding portion 102. In other words, when the filling process S10 is started, the liquid pressure control mechanism 280 is opened with the valve opening mechanism 290. Furthermore, pressure is made to act on the bag body 122 of the storage portion 120, which is disposed in the accommodation space 151 of the accommodation portion 152, with the drive of the pressure mechanism 150. With the above, the bag body 122 is deformed so that the volume of the storage portion 120 becomes small. As a result, the air in the storage portion 120 flows out into the second liquid flow path 112 through the delivering pipe 128.

Subsequently, when it is determined that the volume of the storage portion 120 is smaller than the predetermined volume, the drive of the feed pump mechanism 170 and the drive of the discharge mechanism 50 are started. As a result, the liquid in the liquid supply source 101 is made to flow into the liquid supply flow path 110. Furthermore, the air present in the liquid supply flow path 110 is discharged into the cap 51 through the nozzles 44 of the liquid ejecting portion 41. As a result, the air inside the liquid supply flow path 110 is discharged outside the liquid supply flow path 110 with the execution of the filling process S10.

During the filling process S10, the pressure from the outside acts on the bag body 122 of the storage portion 120 even while the feed pump mechanism 170 and the discharge mechanism 50 are driven. Accordingly, the liquid that has flowed into the introducing pipe 127 of the storage portion 120 through the first liquid flow path 111 of the liquid supply flow path 110 flows out into the second liquid flow path 112 through the connection passage 126 and the delivering pipe 128. In other words, scarcely any liquid remains inside the bag body 122.

Furthermore, when the condition to end the filling process S10, such as the liquid supply flow path 110 being determined to be filled with the liquid, is satisfied, the drive of the discharge mechanism 50 and the drive of the valve opening mechanism 290 are stopped. Subsequently, the filling process S10 is ended and the ending process S20 is started.

Since the drive of the pressure mechanism 150 is stopped when the ending process S20 is started, the increase in the pressure acting on the bag body 122 is stopped. Furthermore, the accommodation space 151 of the accommodation portion 152 and the atmospheric air are made to communicate with each other with the drive of the atmosphere communication portion 160. Due to the above, the pressure of the accommodation space 151 decreases. In other words, the pressure acting on the bag body 122 decreases.

As described above, the drive of the feed pump mechanism 170 is continued even when the accommodation space 151 is made to communicate with the atmospheric air. Accordingly, the liquid discharged from the feed pump mechanism 170 flows into the storage portion 120 through the first liquid flow path 111 of the liquid supply flow path 110. With the above, the bag body 122 is deformed so that the volume of the storage portion 120 becomes larger. Subsequently, when it is determined that the increased amount of liquid inside the storage portion 120 is equivalent to or larger than the predetermined increase amount, since the condition of ending the ending process S20 is satisfied, the drive of the feed pump mechanism 170 is stopped.

Effects of the present exemplary embodiment will be described next.

1. When the filling process S10 is executed, since the pressure is made to act on the bag body 122 of the storage portion 120 with the pressure mechanism 150, the volume of the storage portion 120 becomes small. With the above, the air inside the storage portion 120 can be discharged from the storage portion 120 to the liquid supply flow path 110. Furthermore, in the filling process S10, the liquid is made to flow out from the liquid supply source 101 to the liquid supply flow path 110 with the discharge mechanism 50 and the feed pump mechanism 170. Accordingly, even if there is air in the first liquid flow path 111 of the liquid supply flow path 110, the air can be made to flow into the second liquid flow path 112 by executing the filling process S10. In other words, the state in which there is air in the first liquid flow path 111 can be ended or the amount of air present in the first liquid flow path 111 can be reduced. Subsequently, after the filling process S10 has been executed, the ending process S20 is executed. In the ending process S20, the state in which the pressure is made to act on the bag body 122 is ended. With the above, the liquid is, through the first liquid flow path 111, filled in the storage portion 120 from the liquid supply source 101. In so doing, there is no air in the first liquid flow path 111 or even if there is air in the first liquid flow path 111, the amount will be small. Accordingly, with the execution of the ending process S20, the air can be suppressed from flowing in the storage portion 120 together with the liquid. Accordingly, when the liquid accommodated in the liquid supply source 101 is filled in the liquid supply flow path 110, the amount of air flowing in the storage portion 120 can be reduced.

2. In the present exemplary embodiment, in the filling process S10, the volume of the storage portion 120 is reduced until the portions in the bag body 122 that constitute the storage portion 120 and that oppose each other come in contact with each other. As described above, the liquid is made to flow out from the liquid supply source 101 to the liquid supply flow path 110 with the discharge mechanism 50 and the feed pump mechanism 170 after the air present in the storage portion 120 has been reduced to the extent possible. With the above, a larger amount of liquid can be made to flow into the storage portion 120 with the execution of the ending process S20 preformed subsequently.

3. In the filling process S10, the pressure can be made to act on the bag body 122 and the volume of the storage portion 120 can be reduced by supplying the air into the accommodation space 151 of the accommodation portion 152 with the pressure pump 153 of the pressure mechanism 150. Furthermore, in the ending process S20, the pressure of the accommodation space 151 can be reduced to the atmospheric pressure by driving the atmosphere communication portion 160. With the above, the state in which the pressure acts on the bag body 122 can be ended and the liquid accommodated in the liquid supply source 101 can be filled in the storage portion 120.

4. When the filling process S10 is executed, the liquid accommodated in the liquid supply source 101 is made to flow into the liquid supply flow path 110 with the drive of the feed pump mechanism 170. Furthermore, the air present in the liquid supply flow path 110 is discharged from the liquid ejecting portion 41 to the outside of the liquid supply flow path 110 with the drive of the discharge mechanism 50. With the above, the liquid supply flow path 110 can be filled with the liquid accommodated in the liquid supply source 101. Furthermore, in the ending process S20, the state in which the pressure is made to act on the bag body 122 of the storage portion 120 is ended, and the liquid accommodated in the liquid supply source 101 is made to flow out into the liquid supply flow path 110 with the drive of the feed pump mechanism 170. As a result, the liquid can be filled in the storage portion 120.

The present exemplary embodiment can be modified and implemented in the following manner. The present exemplary embodiment and the following modifications can be implemented in a combined manner within a technically consistent range.

In the filling process S10 executed in the exemplary embodiment described above, the volume of the storage portion 120 is reduced until the portions of the bag body 122 of the storage portion 120 that oppose each other come in contact with each other. However, when the volume of the storage portion 120 can be reduced by the execution of the filling process S10, the processes in step S12 and after illustrated in FIG. 6 may be started before the portions in the bag body 122 that oppose each other come in contact with each other.

In the exemplary embodiment described above, while the bag body 122 of the storage portion 120 is formed by adhering two flexible members 121 to each other, the bag body 122 may be configured in a different manner with respect to the configuration described in the exemplary embodiment described above. For example, the bag body 122 may be formed with a single flexible member 121.

Figure 7:
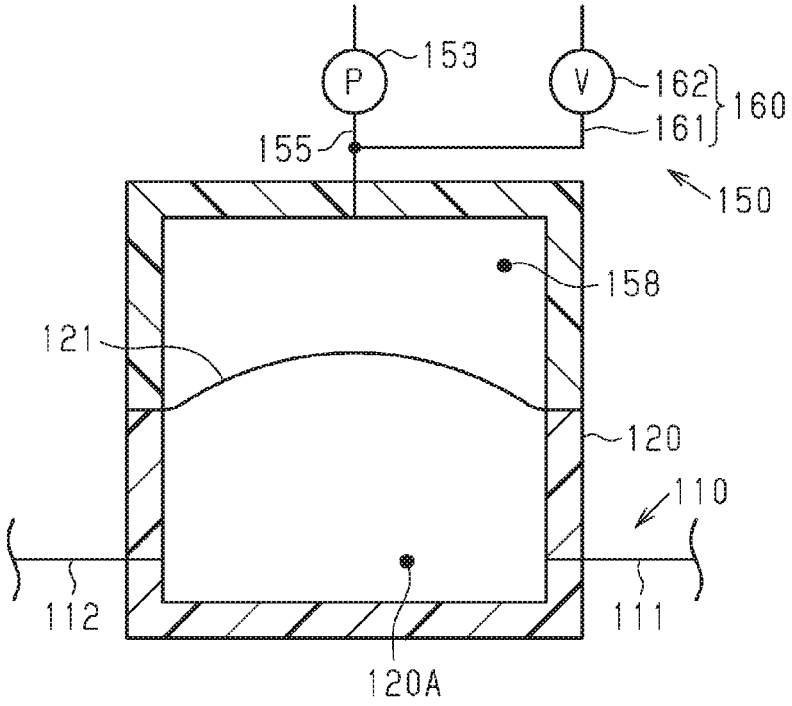
FIG. 7 is a schematic diagram illustrating a configuration of a storage portion of a liquid ejecting apparatus, which is a modification of the liquid ejecting apparatus.

As long as at least a portion of the storage portion 120 is formed of a flexible material, the storage portion 120 may be configured in a different manner with respect to the configuration described in the exemplary embodiment described above. An example of the storage portion 120 is illustrated in FIG. 7. A portion of a wall of the storage portion 120 illustrated in FIG. 7 is formed of the flexible member 121. In such a case, the flexible member 121 functions as the flexible portion. A space inside the storage portion 120 is partitioned with the flexible member 121 into a storage chamber 120A in which the liquid is stored, and a pressure control chamber 158. In such a case, the pressure in the pressure control chamber 158 can be increased with the pressure mechanism 150. Furthermore, when the atmosphere communication valve 162 of the atmosphere communication portion 160 is opened, the pressure control chamber 158 communicates with the atmospheric air.

When the pressure in the pressure control chamber 158 is increased with the pressure pump 153, the pressure of the pressure control chamber 158 acts on the flexible member 121; accordingly, the flexible member 121 becomes deformed so that the volume of the storage portion 120, in other words, the volume of the storage chamber 120A, becomes small. The pressure mechanism 150 increases the pressure in the storage portion 120 in the above manner.

Figure 8:
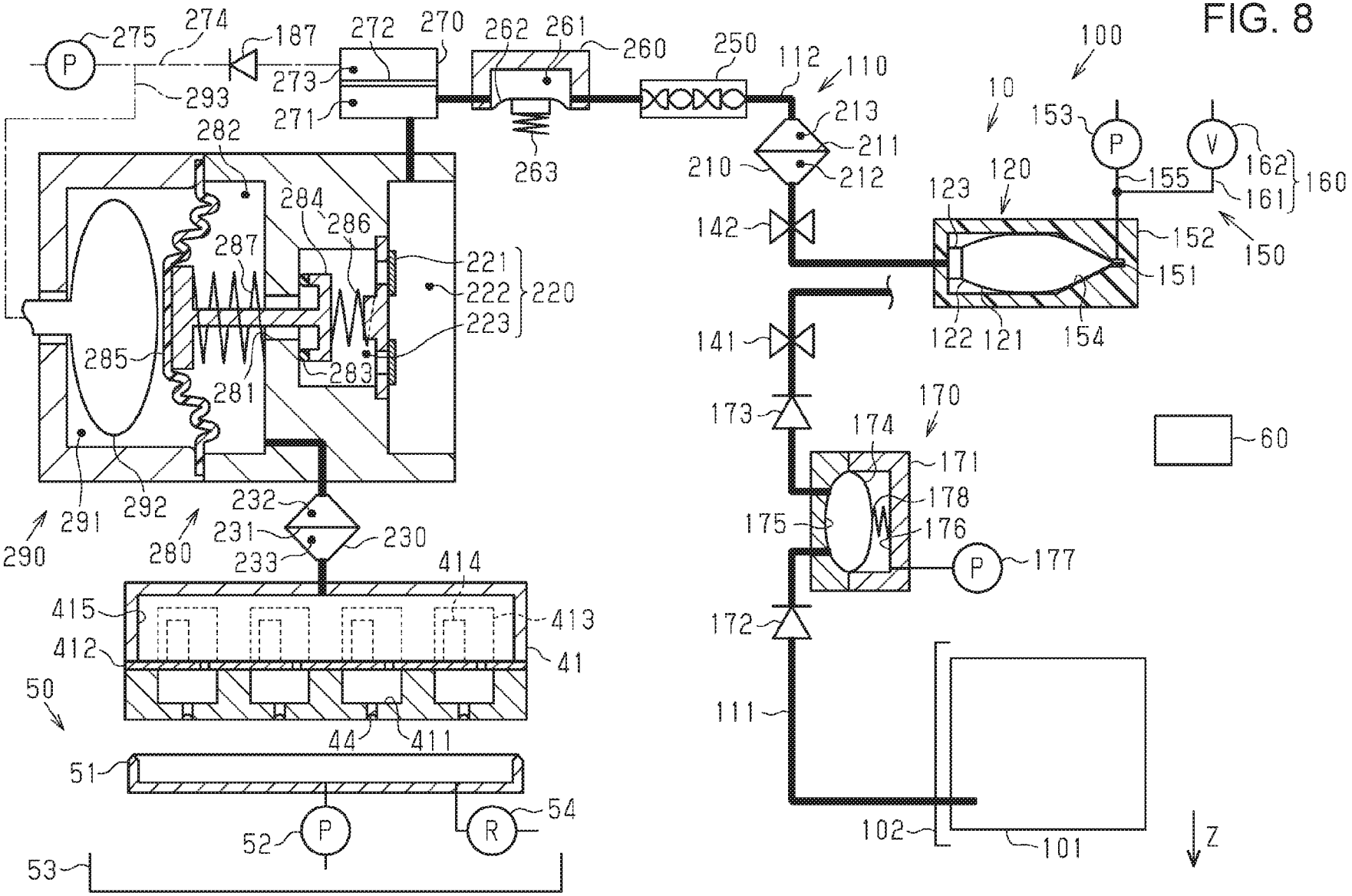
FIG. 8 is a schematic diagram illustrating a configuration of a modification of a liquid ejecting apparatus.

As long as the liquid in the liquid supply source 101 can be supplied to the liquid ejecting portion 41, the liquid supplying apparatus 100 may be configured in a different manner with respect to the configuration described in the exemplary embodiment described above. For example, a configuration illustrated in FIG. 8 may be adopted as the liquid supplying apparatus 100. As illustrated in FIG. 8, the liquid supplying apparatus 100 may be configured to include a plurality of on-off valves. Among the plurality of on-off valves, a first on-off valve 141 is, in the liquid supply flow path 110, an on-off valve positioned between the storage portion 120 and the feed pump mechanism 170, and a second on-off valve 142 is, in the liquid supply flow path 110, an on-off valve positioned between the storage portion 120 and the liquid ejecting portion 41.

The filling process S10 and the ending process S20 when the configuration illustrated in FIG. 8 is adopted as the liquid supplying apparatus 100 will be described.

In the filling process S10, the control portion 60 drives the discharge mechanism 50 while the accommodation space 151 is in communication with the atmospheric air due to the atmosphere communication portion 160, in which the first on-off valve 141 is closed, and in which the second on-off valve 142 is open. By so doing, the air in the second liquid flow path 112 of the liquid supply flow path 110 is discharged from the liquid ejecting portion 41. As a result, a negative pressure acts in the second liquid flow path 112 and on the storage portion 120. In other words, in the example described herein, the discharge mechanism 50 is also made to function as a pressure mechanism.

Furthermore, when a negative pressure acts on the storage portion 120 in the above manner, the flexible member 121 becomes deformed and the volume of the storage portion 120 becomes small. Subsequently, when the volume of the storage portion 120 becomes smaller than the volume thereof before the start of the filling process S10, the control portion 60 opens the first on-off valve 141 and starts to drive the feed pump mechanism 170. In other words, the control portion 60 drives the discharge mechanism 50 and the feed pump mechanism 170 while the first on-off valve 141 and the second on-off valve 142 are open. In so doing, since the negative pressure by the discharge mechanism 50 acts on the storage portion 120, the liquid is filled in the liquid supply flow path 110 while the volume of the storage portion 120 is small compared with when the negative pressure is not applied.

When it is determined that the liquid is filled in the liquid supply flow path 110, the control portion 60 ends the filling process S10 and starts the ending process S20.

In the ending process S20, the control portion 60 stops the drive of the discharge mechanism 50 and closes the second on-off valve 142. With the above, a state in which the negative pressure acts inside the bag body 122 of the storage portion 120 is ended. Subsequently, the control portion 60 continues the drive of the feed pump mechanism 170 while the first on-off valve 141 is open. With the above, the liquid is stored in the storage portion 120 with the feed pump mechanism 170.

Note that when such a control structure is adopted, the pressure mechanism 150 may be omitted in the liquid supplying apparatus 100.

Figure 9:
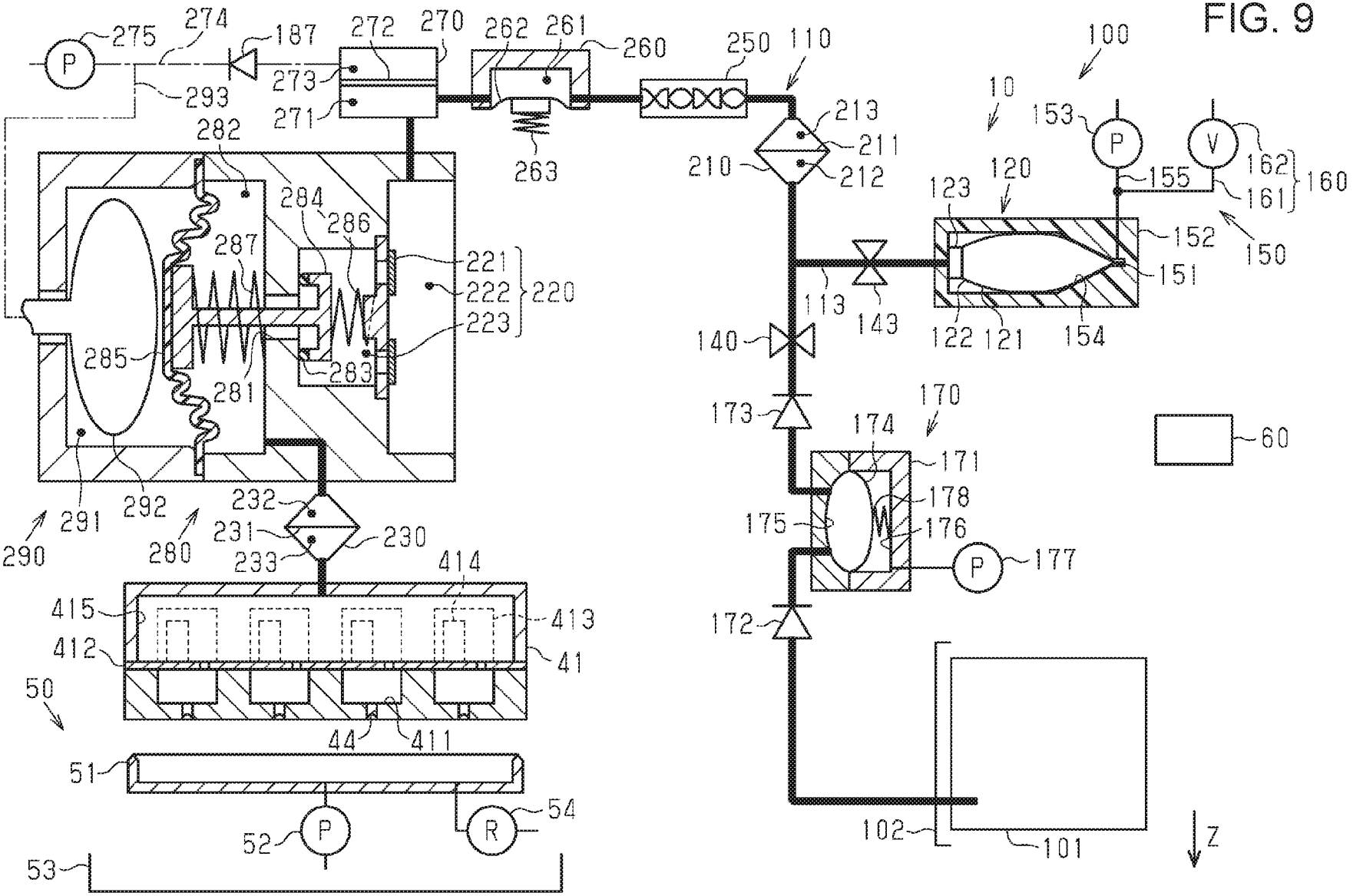
FIG. 9 is a schematic diagram illustrating a configuration of a modification of a liquid ejecting apparatus.

As illustrated in FIG. 9, the storage portion 120 may be coupled to the liquid supply flow path 110 through a single opening. In other words, the storage portion 120 may be configured to include a single opening that functions both as the introducing hole 124 and the delivering hole 125. In such a case, the liquid supply flow path 110 includes a flow path 113 for the storage portion that extends from between the on-off valve 140 and the first filter portion 210 towards the storage portion 120. In such a case, the liquid supplying apparatus 100 may include an on-off valve 143 for the storage portion that opens/closes the flow path 113 for the storage portion.

An example of the filling process S10 in the above case will be described. In the filling process S10, the accommodation space 151 is made to be in communication with the atmospheric air with the atmosphere communication portion 160, the on-off valve 143 for the storage portion is opened, and the on-off valve 140 is closed. When the discharge mechanism 50 is driven in the above state, the air in a portion of the liquid supply flow path 110 downstream of the on-off valve 140 is discharged to the outside through the liquid ejecting portion 41. In so doing, since the on-off valve 143 for the storage portion is open, a negative pressure acts on the storage portion 120 through the liquid supply flow path 110. As a result, the bag body 122 is deformed so that the volume of the storage portion 120 becomes small. As described above, when the volume of the storage portion 120 becomes small, the on-off valve 143 for the storage portion is opened, the on-off valve 140 is opened, and the feed pump mechanism 170 and the discharge mechanism 50 are driven. With the above, the liquid in the liquid supply source 101 is made to flow out to the liquid supply flow path 110. In other words, the liquid is filled in the liquid supply flow path 110 while the volume of the storage portion 120 is small.

When such a filling process S10 is ended, the ending process S20 is executed. In the ending process S20, both the on-off valve 143 for the storage portion and the on-off valve 140 are opened. With the above, the state in which the negative pressure acts on the bag body 122 of the storage portion 120 is ended since the liquid in the liquid supply flow path 110 will flow from upstream of the storage portion 120 to downstream of the storage portion 120. As a result, the liquid flowing in the liquid supply flow path 110 with the drive of the feed pump mechanism 170 flows into the storage portion 120 through the flow path 113 for the storage portion.

In the ending process S20, the liquid may be filled in the storage portion 120 by reducing the pressure acting on the flexible portion with the drive of the pressure mechanism 150.

The atmosphere communication portion 160 may be omitted when the pressure acting on the flexible portion can be increased and decreased with the pressure mechanism 150.

In the exemplary embodiment described above, pressure is made to act on the flexible portion of the storage portion 120 by supplying air with the pressure mechanism 150. However, the pressure mechanism 150 may be a member that makes pressure act on the flexible portion by supplying, rather than gas such as air, a liquid such as water. Furthermore, the pressure mechanism 150 may be a member that makes pressure act on the flexible portion by squashing the flexible portion of the storage portion 120 with a plate-shaped member.

As long as the liquid in the liquid supply source 101 can be drawn and discharged downstream, a pump other than the diaphragm pump may be adopted as the volumetric pump 171. The pump other than the diaphragm pump includes a tube pump, for example. In such a case, the feed pump mechanism 170 may be configured to not include the first regulating valve 172 and the second regulating valve 173.

The medium M that is the subject to which the liquid is ejected by the liquid ejecting apparatus 10 may be a medium other than a sheet of paper. The medium other than a sheet of paper includes a metal film, a plastic film, and fabric, for example.

The liquid ejected by the liquid ejecting portion 41 may be a liquid other than ink. The liquid other than ink may include a liquid body formed of particles of a functional material dispersed or mixed in a liquid, for example. Furthermore, the liquid other than ink may include, for example, a liquid body that contains, in a dispersed or dissolved manner, a material such as an electrode material or a pixel material that is used by the liquid ejecting portion 41 to manufacture liquid crystal displays, electroluminescence displays, and surface emitting displays.

Technical ideas and the effects perceived from the exemplary embodiment and the modifications described above will be described below.

A. A liquid ejecting apparatus includes a liquid ejecting portion that ejects a liquid through a nozzle, a liquid supply flow path configured to supply the liquid accommodated in a liquid supply source to the liquid ejecting portion, a storage portion that is provided in the liquid supply flow path and that stores the liquid, in which the storage portion includes a flexible portion and in which a volume of the storage portion changes when the flexible portion is deformed, a pressure mechanism that changes the volume of the storage portion by making pressure act on the flexible portion, a liquid filling mechanism that fills the liquid inside the liquid supply source into the liquid supply flow path, and a control portion that controls the pressure mechanism and the liquid filling mechanism. The control portion executes a filling process that fills the liquid into the liquid supply flow path with the liquid filling mechanism while the volume of the storage portion is, by making pressure act on the flexible portion with the pressure mechanism, made smaller than when the pressure does not act on the flexible portion, and after executing the filling process, an ending process that ends a state in which the pressure is made to act on the flexible portion with the pressure mechanism.

According to the above configuration, when the filling process is executed, since the pressure is made to act on the flexible portion of the storage portion with the pressure mechanism, the volume of the storage portion becomes small. With the above, even when air is stagnated in the storage portion, the air can be discharged to the liquid supply flow path from the storage portion. Furthermore, in the filling process, the liquid is made to flow from the liquid supply source to the liquid supply flow path with the liquid filling mechanism. Accordingly, the air in the upstream portion, which is a portion of the liquid supply flow path between the liquid supply source and the storage portion, is made to flow downstream with respect to the upstream portion with the execution of the filling process. In other words, the state in which there is air in the upstream portion can be ended or the amount of air present in the upstream portion can be reduced. Subsequently, the ending process is executed after the filling process has been executed. In the ending process, the state in which the pressure is made to act on the flexible portion is ended. With the above, the liquid is, through the upstream flow path, filled in the storage portion from the liquid supply source. In so doing, there is no air in the upstream portion or even if there is air in the upstream portion, the amount will be small. Accordingly, with the execution of the ending process, the air can be suppressed from flowing in the storage portion together with the liquid. Accordingly, when the liquid accommodated in the liquid supply source is filled in the liquid supply flow path, the amount of air flowing in the storage portion can be reduced.

B. In an aspect of the liquid ejecting apparatus described above, the storage portion includes a bag body, the bag body being constituted by a flexible member serving as the flexible portion. In such a case, in the filling process, the control portion fills the liquid in the liquid supply flow path with the liquid filling mechanism after portions of the flexible portion that oppose each other are made to come in contact with each other with the pressure mechanism.

According to the configuration described above, in the filling process, the portions in the flexible portion that constitute the storage portion and that oppose each other come in contact with each other. With the above, the air present in the storage portion can be reduced to the smallest amount possible. Furthermore, the liquid is filled in the liquid supply flow path in the above state. Accordingly, a large amount of liquid can be supplied to the storage portion with the execution of the succeeding ending process.

C. An aspect of the liquid ejecting apparatus described above includes an accommodation portion that accommodates the storage portion thereinside. Furthermore, the pressure mechanism may include a pressure pump that applies pressure to an accommodation space by supplying air in the accommodation space that is a space in the accommodation portion in which the storage portion is disposed, and an atmosphere communication portion that communicates the accommodation space and atmospheric air with each other. In the filling process, the control portion makes the pressure act on the flexible portion by driving the pressure pump, and in the ending process, the control portion ends the state in which the pressure is applied to the flexible portion by driving the atmosphere communication portion.

According to the above configuration, in the filling process, the pressure can be made to act on the flexible portion and the volume of the storage portion can be reduced by supplying the air into the accommodation space of the accommodation portion with the pressure pump. Furthermore, in the ending process, the pressure of the accommodation space can be reduced to the atmospheric pressure by driving the atmosphere communication portion. With the above, the state in which the pressure acts on the flexible portion can be ended and the liquid accommodated in the liquid supply source can be filled in the storage portion.

D. An aspect of the liquid ejecting apparatus according to the above includes a liquid pressure control mechanism provided in the liquid supply flow path between the storage portion and the liquid ejecting portion, in which the liquid pressure control mechanism includes a pressure control valve configured to open/close the liquid supply flow path. In such a case, the liquid pressure control mechanism is configured to open when a flow path pressure, which is a pressure in the liquid supply flow path between the pressure control valve and the liquid ejecting portion, is lower than an outside air pressure and when a difference between the flow path pressure and the outside air pressure is equivalent to or larger than a set value. The liquid filling mechanism includes a feed pump mechanism disposed in the liquid supply flow path between the storage portion and the liquid supply source, the feed pump mechanism suctioning the liquid inside the liquid supply source and discharging the liquid towards the liquid ejecting portion, and a discharge mechanism that discharges the liquid inside the liquid supply flow path to outside of the liquid supply flow path from the liquid ejecting portion by reducing the pressure in the liquid supply flow path through the liquid ejecting portion. The control portion, in the filling process, fills the liquid into the liquid supply flow path by driving the feed pump mechanism and the discharge mechanism while the volume of the storage portion is, by making pressure act on the flexible portion with the pressure mechanism, made smaller than when the pressure does not act on the flexible portion, and in the ending process, ends the state in which the pressure is made to act on the flexible portion with the pressure mechanism, and fills the liquid in the storage portion by driving the feed pump mechanism.

According to the above configuration, when the filling process is executed, the liquid accommodated in the liquid supply source is made to flow into the liquid supply flow path with the drive of the feed pump mechanism. Furthermore, the air present in the liquid supply flow path is discharged from the liquid ejecting portion to the outside of the liquid supply flow path with the drive of the discharge mechanism. With the above, the liquid supply flow path can be filled with the liquid accommodated in the liquid supply source. Furthermore, in the ending process, the state in which the pressure is made to act on the flexible portion of the storage portion is ended, and the liquid accommodated in the liquid supply source is made to flow out into the liquid supply flow path with the drive of the feed pump mechanism. As a result, the liquid can be filled in the storage portion.

E. A method of filling a liquid in a liquid ejecting apparatus is a method of filling a liquid in a liquid ejecting apparatus including a liquid ejecting portion that ejects the liquid through a nozzle, a liquid supply flow path configured to supply the liquid accommodated in a liquid supply source to the liquid ejecting portion, and a storage portion that is provided in the liquid supply flow path and that stores the liquid, in which the storage portion includes a flexible portion and changes a volume thereof when the flexible portion is deformed. In the filling method, the liquid is filled into the liquid supply flow path while the volume of the storage portion is, by making pressure act on the flexible portion, made smaller than when the pressure does not act on the flexible portion, and after the filling, a state in which the pressure is made to act on the flexible portion is ended. According to the above configuration, an effect that is the same as that of the liquid ejecting apparatus described above can be obtained.

F. In an aspect of the method of filling a liquid in the liquid ejecting apparatus described above, the liquid in the storage portion is filled by ending the state in which pressure is made to act on the flexible portion after filling the liquid in the liquid supply flow path. According to the above configuration, an effect that is the same as that of the liquid ejecting apparatus described above can be obtained.

What is claimed is:

1. A liquid ejecting apparatus comprising:

a liquid ejecting portion that ejects a liquid through a nozzle;

a liquid supply flow path configured to supply the liquid accommodated in a liquid supply source to the liquid ejecting portion;

a storage portion that is provided in the liquid supply flow path and that stores the liquid, wherein the storage portion includes a flexible portion and changes a volume thereof when the flexible portion is deformed;

a pressure mechanism that changes the volume of the storage portion by making pressure act on the flexible portion;

a liquid filling mechanism that includes a feed pump mechanism disposed in the liquid supply flow path between the storage portion and the liquid supply source, wherein the feed pump mechanism suctions the liquid inside the liquid supply source and discharges the liquid towards the liquid ejecting portion through the liquid supply flow path, and a discharge mechanism that discharges the liquid inside the liquid supply flow path to outside of the liquid supply flow path from the liquid ejecting portion by reducing the pressure in the liquid supply flow path through the liquid ejecting portion; and a control portion that controls the pressure mechanism and the liquid filling mechanism, wherein the control portion executes, a filling process that fills the liquid into the liquid supply flow path by driving the feed pump mechanism and the discharge mechanism while the volume of the storage portion is, by making pressure act on the flexible portion with the pressure mechanism, made smaller than when the pressure does not act on the flexible portion, after executing the filling process, an ending process that ends a state in which the pressure is made to act on the flexible portion with the pressure mechanism, and after executing the ending process, a filling of the liquid in the storage portion by driving the feed pump mechanism.

2. The liquid ejecting apparatus according to claim 1, wherein the storage portion includes a bag body, the bag body being constituted by a flexible member serving as the flexible portion, and in the filling process, the control portion fills the liquid in the liquid supply flow path with the liquid filling mechanism after portions of the flexible portion that oppose each other are made to come in contact with each other with the pressure mechanism.

3. The liquid ejecting apparatus according to claim 1, further comprising:

a liquid pressure control mechanism provided in the liquid supply flow path between the storage portion and the liquid ejecting portion, the liquid pressure control mechanism including a pressure control valve configured to open/close the liquid supply flow path, wherein the liquid pressure control mechanism is configured to open when a flow path pressure, which is a pressure in the liquid supply flow path between the pressure control valve and the liquid ejecting portion, is lower than an outside air pressure and when a difference between the flow path pressure and the outside air pressure is equivalent to or larger than a set value.

4. A method of filling a liquid in a liquid ejecting apparatus including a liquid ejecting portion that ejects the liquid through a nozzle, a liquid supply flow path configured to supply the liquid accommodated in a liquid supply source to the liquid ejecting portion, and a storage portion that is provided in the liquid supply flow path and that stores the liquid, wherein the storage portion includes a flexible portion and changes a volume thereof when the flexible portion is deformed, a pressure mechanism that changes the volume of the storage portion by making pressure act on the flexible portion, and a liquid filling mechanism, wherein the liquid filling mechanism includes a feed pump mechanism disposed in the liquid supply flow path between the storage portion and the liquid supply source, wherein the feed pump mechanism suctions the liquid inside the liquid supply source and discharges the liquid towards the liquid ejecting portion through the liquid supply flow path, and a discharge mechanism that discharges the liquid inside the liquid supply flow path to outside of the liquid supply flow path from the liquid ejecting portion by reducing the pressure in the liquid supply flow path through the liquid ejecting portion, the method comprising:

filling the liquid into the liquid supply flow path by driving the feed pump mechanism and the discharge mechanism while the volume of the storage portion is, by making pressure act on the flexible portion with the pressure mechanism, made smaller than when the pressure does not act on the flexible portion, and ending, after the filling, a state in which the pressure is made to act on the flexible portion with the pressure mechanism, and filling, after the ending, the liquid in the storage portion by driving the feed pump mechanism.

* * * * *